US008652594B2

(12) United States Patent
Koenig et al.

(10) Patent No.: US 8,652,594 B2
(45) Date of Patent: Feb. 18, 2014

(54) RECORDING SHEET WITH ENHANCED PRINT QUALITY AT LOW ADDITIVE LEVELS

(75) Inventors: Michael F. Koenig, Loveland, OH (US); Jacob P. John, Loveland, OH (US); Thomas R. Arnson, Loveland, OH (US); Benjamin T. Liguzinski, Cincinnati, OH (US)

(73) Assignee: International Paper Company, Memphis, TN (US)

( * ) Notice: Subject to any disclaimer, the term of this patent is extended or adjusted under 35 U.S.C. 154(b) by 308 days.

(21) Appl. No.: 12/415,819

(22) Filed: Mar. 31, 2009

(65) Prior Publication Data

US 2009/0274855 A1 Nov. 5, 2009

Related U.S. Application Data

(60) Provisional application No. 61/040,806, filed on Mar. 31, 2008.

(51) Int. Cl.

| | |
|---|---|
| ***B41M 5/40*** | (2006.01) |
| ***B41M 5/50*** | (2006.01) |
| ***B41M 5/52*** | (2006.01) |

(52) U.S. Cl.

CPC ..... *B41M 5/502* (2013.01); *B41M 5/508* (2013.01); *B41M 5/52* (2013.01); *B41M 5/5218* (2013.01); *B41M 5/5227* (2013.01); *B41M 5/5245* (2013.01); *B41M 5/5254* (2013.01)

USPC ..... 428/32.21; 428/32.3; 428/32.31; 428/32.34

(58) Field of Classification Search

CPC ..... B41M 5/502; B41M 5/508; B41M 5/52; B41M 5/5218; B41M 5/5227; B41M 5/5245; B41M 5/5254

USPC ..... 428/32.21, 32.3, 32.31, 32.34

See application file for complete search history.

(56) References Cited

U.S. PATENT DOCUMENTS

| | | | |
|---|---|---|---|
| 1,373,788 | A | 4/1921 | Ball |
| 2,322,888 | A | 6/1943 | Schultz |
| 2,628,918 | A | 2/1953 | Wilson et al. |
| 2,680,734 | A | 6/1954 | Dearing |
| 2,684,300 | A | 7/1954 | Wilson et al. |

(Continued)

FOREIGN PATENT DOCUMENTS

| | | |
|---|---|---|
| EP | 0181646 A2 | 11/1985 |
| EP | 0652324 | 5/1995 |

(Continued)

OTHER PUBLICATIONS

Paper and board, Determination of sizing, Stoeckigt method, JIS p. 8122: 2004, rev. Mar. 20, 2004, published by Japanese Standards Association.

(Continued)

*Primary Examiner* — Betelhem Shewareged

(74) *Attorney, Agent, or Firm* — Thomas W. Barnes, III

(57) ABSTRACT

A recording sheet is provided, which comprises: a paper substrate comprising a plurality of cellulosic fibers; and a sizing agent comprising a water soluble divalent metal salt; wherein the paper substrate and sizing agent cooperate to form an I-beam structure. Methods of making and using the recording sheet are also provided.

22 Claims, 15 Drawing Sheets

Starch Penetration

Sample A: no I-Beam

Starch Penetration (10x Objective)

Sample B: I-Beam

Starch Penetration (10x Objective)

(56) References Cited

U.S. PATENT DOCUMENTS

| | | | | |
|---|---|---|---|---|
| 2,763,572 | A | 9/1956 | Staehle | |
| 3,293,114 | A | 12/1966 | Kenaga et al. | |
| 3,533,908 | A | 10/1970 | Hoogsteen | |
| 3,556,934 | A | 1/1971 | Meyer | |
| 3,582,464 | A | 6/1971 | Alrich | |
| 3,600,385 | A | 8/1971 | Loffelman | |
| 3,615,972 | A | 10/1971 | Morehouse et al. | |
| 3,719,514 | A | 3/1973 | Taylor | |
| 3,864,181 | A | 2/1975 | Wolinski et al. | |
| 3,956,283 | A | 5/1976 | Fleck | |
| 3,966,654 | A | 6/1976 | Aldrich | |
| 4,006,273 | A | 2/1977 | Wolinski et al. | |
| 4,017,431 | A | 4/1977 | Aldrich | |
| 4,022,965 | A | 5/1977 | Goheen et al. | |
| 4,040,900 | A | 8/1977 | Mazzarella et al. | |
| 4,044,176 | A | 8/1977 | Wolinski et al. | |
| 4,075,136 | A | 2/1978 | Schaper | |
| 4,133,688 | A | 1/1979 | Sack | |
| 4,166,894 | A | 9/1979 | Schaper | |
| 4,174,417 | A | 11/1979 | Rydell | |
| 4,251,824 | A | 2/1981 | Hara et al. | |
| 4,263,182 | A | 4/1981 | Aldrich | |
| 4,289,808 | A | 9/1981 | Huang | |
| 4,381,185 | A | 4/1983 | Swanson et al. | |
| 4,410,899 | A | 10/1983 | Haruta et al. | |
| 4,412,224 | A | 10/1983 | Sugitani | |
| 4,431,481 | A | 2/1984 | Drach et al. | |
| 4,483,889 | A | 11/1984 | Andersson | |
| 4,496,427 | A | 1/1985 | Davison | |
| 4,532,530 | A | 7/1985 | Hawkins | |
| 4,540,635 | A | 9/1985 | Ronge et al. | |
| 4,554,181 | A | 11/1985 | Cousin et al. | |
| 4,601,777 | A | 7/1986 | Hawkins et al. | |
| 4,630,080 | A * | 12/1986 | Satake et al. | 503/209 |
| 4,721,655 | A | 1/1988 | Trzasko | |
| 4,722,943 | A | 2/1988 | Melber et al. | |
| 4,829,094 | A | 5/1989 | Melber et al. | |
| 4,835,212 | A | 5/1989 | Degen et al. | |
| 4,855,343 | A | 8/1989 | Degen et al. | |
| 4,986,882 | A | 1/1991 | Mackey et al. | |
| 5,049,235 | A | 9/1991 | Barcus et al. | |
| 5,125,996 | A | 6/1992 | Campbell et al. | |
| 5,160,789 | A | 11/1992 | Barcus et al. | |
| 5,201,944 | A | 4/1993 | Nakata et al. | |
| 5,209,953 | A | 5/1993 | Grupe et al. | |
| 5,242,545 | A | 9/1993 | Bradway et al. | |
| 5,266,250 | A | 11/1993 | Kroyer | |
| 5,358,998 | A | 10/1994 | Wendel et al. | |
| 5,360,420 | A | 11/1994 | Cook et al. | |
| 5,374,335 | A | 12/1994 | Lindgren et al. | |
| 5,429,860 | A | 7/1995 | Held et al. | |
| 5,443,899 | A | 8/1995 | Barcus et al. | |
| 5,514,429 | A | 5/1996 | Kamihgaraguchi et al. | |
| 5,531,728 | A | 7/1996 | Lash | |
| 5,662,773 | A | 9/1997 | Frederick et al. | |
| 5,667,637 | A | 9/1997 | Jewell et al. | |
| 5,685,815 | A | 11/1997 | Bottorff et al. | |
| 5,698,074 | A | 12/1997 | Barcus et al. | |
| 5,698,688 | A | 12/1997 | Smith et al. | |
| H1704 | H | 1/1998 | Wallajapet et al. | |
| 5,731,080 | A | 3/1998 | Cousin et al. | |
| 5,792,317 | A | 8/1998 | Taylor et al. | |
| 5,858,076 | A | 1/1999 | Thompson | |
| 5,985,030 | A | 11/1999 | Taylor et al. | |
| 5,997,692 | A | 12/1999 | Taylor et al. | |
| 6,123,760 | A | 9/2000 | Varnell | |
| 6,146,494 | A | 11/2000 | Seger et al. | |
| 6,162,328 | A | 12/2000 | Cennisio et al. | |
| 6,207,258 | B1 | 3/2001 | Varnell | |
| 6,220,157 | B1 | 4/2001 | Delwiche et al. | |
| 6,350,507 | B1 | 2/2002 | Iwamoto et al. | |
| 6,361,651 | B1 | 3/2002 | Sun | |
| 6,372,361 | B1 | 4/2002 | Mackewicz et al. | |
| 6,379,497 | B1 | 4/2002 | Sandstrom et al. | |
| 6,471,824 | B1 | 10/2002 | Jewell | |
| 6,485,139 | B1 | 11/2002 | Lavery et al. | |
| 6,506,282 | B2 | 1/2003 | Hu et al. | |
| 6,521,088 | B1 | 2/2003 | Richardson et al. | |
| 6,579,414 | B2 | 6/2003 | Jewell | |
| 6,579,415 | B2 | 6/2003 | Jewell | |
| 6,582,557 | B2 | 6/2003 | Jewell | |
| 6,592,712 | B2 | 7/2003 | Koukoulas et al. | |
| 6,592,717 | B2 | 7/2003 | Jewell | |
| 6,617,364 | B2 | 9/2003 | Soane et al. | |
| 6,686,054 | B2 | 2/2004 | Nigam | |
| 6,761,977 | B2 | 7/2004 | Nigam | |
| 6,764,726 | B1 | 7/2004 | Yang et al. | |
| 6,880,928 | B2 | 4/2005 | Hosoi et al. | |
| 6,890,454 | B2 | 5/2005 | Farrar et al. | |
| 6,893,473 | B2 | 5/2005 | Neogi et al. | |
| 6,977,100 | B2 | 12/2005 | Kondo et al. | |
| 7,214,728 | B2 | 5/2007 | Kimpimaki et al. | |
| 7,429,309 | B2 | 9/2008 | Propst, Jr. et al. | |
| 7,582,188 | B2 | 9/2009 | Stoffel et al. | |
| 7,736,466 | B2 | 6/2010 | Singh et al. | |
| 7,967,953 | B2 | 6/2011 | Singh et al. | |
| 8,012,551 | B2 | 9/2011 | Song et al. | |
| 8,123,907 | B2 | 2/2012 | Stoffel et al. | |
| 2001/0044477 | A1 | 11/2001 | Soane et al. | |
| 2003/0008931 | A1 | 1/2003 | Soane et al. | |
| 2003/0008932 | A1 | 1/2003 | Soane et al. | |
| 2003/0152724 | A1 | 8/2003 | Swoboda et al. | |
| 2003/0173045 | A1 | 9/2003 | Confalone et al. | |
| 2003/0227531 | A1 | 12/2003 | Hosoi | |
| 2004/0033377 | A1 * | 2/2004 | Koenig | 428/458 |
| 2004/0065423 | A1 | 4/2004 | Swerin et al. | |
| 2004/0123966 | A1 | 7/2004 | Altman et al. | |
| 2004/0157057 | A1 | 8/2004 | Tasaki et al. | |
| 2004/0197500 | A9 | 10/2004 | Swoboda et al. | |
| 2004/0221976 | A1 | 11/2004 | Williams | |
| 2005/0104947 | A1 | 5/2005 | Ogino et al. | |
| 2005/0124755 | A1 | 6/2005 | Mitchell | |
| 2005/0193906 | A1 | 9/2005 | Nakamura et al. | |
| 2006/0051528 | A1 | 3/2006 | Ogino | |
| 2006/0102307 | A1 | 5/2006 | Kron et al. | |
| 2006/0124263 | A1 | 6/2006 | Lipponen et al. | |
| 2006/0177608 | A1 * | 8/2006 | Burch et al. | 428/32.24 |
| 2006/0191656 | A1 | 8/2006 | Buzza et al. | |
| 2006/0254738 | A1 | 11/2006 | Anderson | |
| 2007/0087138 | A1 | 4/2007 | Koenig et al. | |
| 2007/0161115 | A1 | 7/2007 | Schwartz et al. | |
| 2007/0171267 | A1 | 7/2007 | Tojo et al. | |
| 2008/0035292 | A1 | 2/2008 | Singh et al. | |
| 2008/0098931 | A1 | 5/2008 | Skaggs et al. | |
| 2008/0206571 | A1 | 8/2008 | Berckmans et al. | |
| 2009/0017235 | A1 | 1/2009 | Bays et al. | |
| 2009/0266501 | A1 | 10/2009 | Stoffel et al. | |
| 2009/0274855 | A1 | 11/2009 | Koenig et al. | |
| 2009/0295892 | A1 | 12/2009 | Akiyama et al. | |
| 2009/0320708 | A1 | 12/2009 | Jackson et al. | |
| 2010/0129553 | A1 | 5/2010 | Jackson et al. | |
| 2011/0151148 | A1 | 6/2011 | Koenig et al. | |
| 2011/0151149 | A1 | 6/2011 | Koenig | |
| 2011/0240241 | A1 | 10/2011 | Koenig et al. | |
| 2011/0240242 | A1 | 10/2011 | Koenig et al. | |
| 2011/0274856 | A1 | 11/2011 | Koenig et al. | |
| 2012/0012265 | A1 | 1/2012 | Singh et al. | |
| 2012/0019587 | A1 | 1/2012 | Koenig | |
| 2012/0121872 | A1 | 5/2012 | Koenig | |

FOREIGN PATENT DOCUMENTS

| | | | |
|---|---|---|---|
| EP | 0747235 | | 12/1996 |
| EP | 10166715 | | 6/1998 |
| EP | 0666368 | B1 | 6/1999 |
| EP | 0943450 | | 9/1999 |
| EP | 1036666 | A1 | 9/2000 |
| EP | 2000263918 | | 9/2000 |
| EP | 2000280613 | | 10/2000 |
| EP | 1079356 | | 2/2001 |
| EP | 0629741 | B1 | 8/2001 |
| EP | 1122085 | | 8/2001 |
| EP | 2001328340 | | 11/2001 |
| EP | 0999937 | B1 | 3/2002 |

(56) References Cited

FOREIGN PATENT DOCUMENTS

| | | | |
|---|---|---|---|
| EP | 2002274012 | | 9/2002 |
| EP | 1355004 | | 10/2003 |
| EP | 2004255593 | | 6/2004 |
| EP | 1566281 | | 8/2005 |
| EP | 1571149 | | 9/2005 |
| EP | 2006168017 | | 6/2006 |
| EP | 1712677 | | 10/2006 |
| EP | 1743976 | | 1/2007 |
| EP | 1775141 | | 4/2007 |
| EP | 1775141 | A1 | 4/2007 |
| EP | 1947240 | | 7/2008 |
| GB | 551950 | | 9/1941 |
| GB | 7866543 | | 11/1957 |
| GB | 903416 | | 8/1962 |
| GB | 2307487 | | 5/1997 |
| JP | 10-166715 | | 6/1998 |
| JP | 2000-263918 | | 9/2000 |
| JP | 2000-280613 | | 10/2000 |
| JP | 2001-328340 | | 11/2001 |
| JP | 2002-274012 | | 9/2002 |
| JP | 2004-255593 | | 6/2004 |
| JP | 2006-168017 | | 6/2006 |
| RU | 98112275 | | 6/1997 |
| RU | 2107121 | | 3/1998 |
| RU | 2177521 | | 12/2001 |
| RU | 2266995 | | 12/2005 |
| SU | 1607691 | | 11/1990 |
| WO | 8600100 | | 1/1986 |
| WO | 9609345 | | 3/1996 |
| WO | 9722754 | | 6/1997 |
| WO | 9745590 | | 12/1997 |
| WO | WO9745590 | A1 | 12/1997 |
| WO | 9833982 | | 8/1998 |
| WO | 9906219 | | 2/1999 |
| WO | 9916973 | | 4/1999 |
| WO | 0151708 | | 7/2001 |
| WO | 03044275 | | 5/2003 |
| WO | 2005024131 | | 3/2005 |
| WO | 2005115763 | | 12/2005 |
| WO | 2005118953 | | 12/2005 |
| WO | 2006049545 | | 5/2006 |
| WO | 2006086736 | | 8/2006 |
| WO | 2006099364 | | 9/2006 |
| WO | 2006110751 | | 10/2006 |
| WO | 2007008786 | | 1/2007 |
| WO | 2007053681 | | 5/2007 |
| WO | 2007084571 | | 7/2007 |
| WO | 2007141271 | | 12/2007 |
| WO | 2008055858 | | 5/2008 |
| WO | 2009110910 | | 9/2009 |
| WO | 2009124075 | | 10/2009 |
| WO | 2009146416 | | 12/2009 |

OTHER PUBLICATIONS

Use of T530 HST on calcium carbonate-containing papers, Stever R. Boone, 1996, Tappi Journal, pp. 122-124.

Tracing Tecnique in Geohydrology by Werner Kass and Horst Behrens, published by Taylor and Francis, 1998, pp. 48-55.

Sythetic Detergents in the Soap Industry Lime Soap Dispersion Test, H.C. Borghetty et al., J. Am. Oil, Chem. Soc., 27:88-90 1950.

Smook, Handbook for Pulp and Paper Technologist, 2nd edition, 1992, pp. 283-298.

Quantitative Determination of Alkyl Ketene dimer AKD retention in Paper made on a Pilot Paper Machine, p. 253-260.

Automataic Color recognition System for Stockigt Sizing Test II, Journal of Korea TAPPI, 37,1,73-81, 2005.

Lipids in Cereal Staraches: A Review; William R. Morrison; Jounal of Cereal Science 8-1988, pp. 1-15.

High Solids Modified Calcium Carbonates A Concept for Inkjet Papers, Varney Kukkamo, May 2010.

BeMiller et al., Starch, Ullmann's Encyclopedia of Industrial Chemistry, vol. 34, pp. 113-117. online John Wiley Sons, Inc. 2011 Retrieved on May 16, 2012 Retrieved from Internet: URL http-onlinelibrary.wiley.com-doi-10.1002-14356007.a25_001.pub4-full.

C. E. Farley; R. B. Wasser. The Sizing of Paper. TAPPI Press, pp. 51-62, 1989.

Chemistry and Application of Rosin Size, E. Strazdins, pp. 1-31, 1989.

Pigment Coating Techniques, Chapter 24, p. 415-417, Jukka Linnonmaa and Michael Trefz, 2000.

* cited by examiner

Starch Penetration

Sample A: no I-Beam

Starch Penetration (10x Objective)

Sample B: I-Beam

Starch Penetration (10x Objective)

DT Coater Results

Both DT Coater conditions gave I-Beam structure

Sample 7: DT Coater Cond 4A

Starch Penetration (10x Objective)

Sample 8: DT Coater Cond 4B

Starch Penetration (10x Objective)

DT Coater Results

Mill Trial Results

DT Coater/Puddle Coater Results

DT Coater/Puddle/Mill 1/Mill 2 Results

DT Coater/Puddle/Mill 2 Results

DT Coater/Puddle/Mill 1 Results

Puddle/DT Coater Results

Puddle/DT Coater Results

Puddle/DT Coater/Mill 1/Mill 2 Results

Puddle/DT Coater Results – Conditions A, B, E

Puddle/DT Coater Results – Conditions A, B, E

Puddle/DT Coater Results – Conditions A, B, E

Puddle/DT Coater Results – Conditions A, B, E

RECORDING SHEET WITH ENHANCED PRINT QUALITY AT LOW ADDITIVE LEVELS

BACKGROUND

1. Field of the Invention

This invention relates to recording sheets, for example, a paper based recording sheet, having enhanced print quality. The invention also relates to methods of making and methods of using the recording sheets. While suitable for use in any printing process, the recording sheets are particularly useful in ink jet printing processes.

2. Discussion of the Background

Paper substrates having the so-called, "I-Beam" structure have been recently developed and are reported to have improved bulk stiffness and/or high dimensional stability. See, for example, U.S. Patent Application Publication 2004/0065423, published on Apr. 8, 2004, which discloses a three-layered single-ply I-Beam structure sheet with a cellulosic central layer and top and bottom layers having starch-based size pressed coatings. See also U.S. Patent Application Publication 2008/0035292, published on Feb. 14, 2008, which discloses paper substrates having high dimensional stability with high surface sizing and low internal sizing.

Calcium chloride is currently used in ink jet recording media to enhance inkjet print density and dry time. See, for example, U.S. Patent Application Publication 2007/0087138, published on Apr. 19, 2007, which discloses a recording sheet with improved image dry time which contains water soluble divalent metal salts. Other metal salts have been used in ink jet recording media. U.S. Pat. No. 4,381,185 discloses paper stock which contains polyvalent metal cations. U.S. Pat. No. 4,554,181 discloses an ink jet recording sheet having a recording surface which includes a water soluble polyvalent metal salt. U.S. Pat. No. 6,162,328 discloses a paper sizing for ink jet printing substrate that includes various cationic metal salts. U.S. Pat. No. 6,207,258 discloses a surface treatment composition for an ink jet printing substrate which contains a divalent metal salt. U.S. Pat. No. 6,880,928 discloses an ink jet recording base paper having a coating which includes a polyvalent metal salt.

The present inventors have found that the use of calcium chloride can be problematic. High levels of calcium chloride can create runnability issues in paper machines; calcium chloride undesirably quenches stilbene-based optical brighteners such as often used at the size press; and calcium chloride affects the pH of size press formulations. Starches used at the size press require a narrow pH range to be effective: too high of a pH may result in the yellowing of the starch; too low of a pH may cause the starch to precipitate and/or gel. Calcium chloride can also interact with other chemicals such as those used in the wet end when the paper is broked or recycled.

There is thus a need for a recording sheet in which improved ink jet print density and other benefits are maintained but which avoids the runnability and formulation issues associated with calcium chloride.

SUMMARY

The above problems, and others, are solved by the present invention. Quite surprisingly, the present inventors have found that a recording sheet, comprising at least one water soluble divalent metal salt and an I-beam structure exhibits a significantly improved gamut volume, ink jet print density, and several other advantages mentioned herein. These advantages could not have been predicted. Without wishing to be bound by theory, it is believed that the effective surface concentration of water soluble divalent metal salts is enhanced with the I-beam structure; and the enhanced effective surface concentration in combination with the I-beam structure allows a reduction in the overall amount of additives in the recording sheet without sacrificing performance. Still other advantages include reduced ink transfer immediately after printing, improved image black density, and improved edge acuity when printed with pigment-based inks.

One embodiment of the present invention desirably attains equal or better print density and dry time at much lower metal salt levels. One embodiment of the present invention achieves lower amounts of metal salt, such as calcium chloride; improved paper machine runnability; and desirably reduced interaction with other papermaking chemicals. Other advantages of the present invention are reduced amounts of additives at the paper machine, which improves the runnability of the paper machine and reduces cost without sacrificing performance.

In another embodiment, the present inventors have found that the addition of surface pigments such as GCC (ground calcium carbonate), PCC (precipitated calcium carbonate), and others synergistically improves the gamut volume and dry time.

BRIEF DESCRIPTION OF THE DRAWINGS

Various embodiments of the present invention are described in conjunction with the accompanying drawings, in which.

DETAILED DESCRIPTION OF THE SEVERAL EMBODIMENTS

Figure 1:
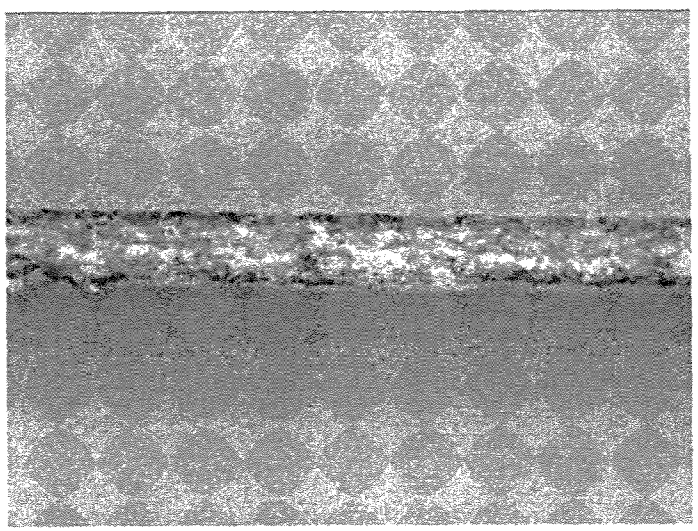
FIG. 1 shows an optical microscope evaluation of starch penetration in comparative and exemplary embodiments of the present invention.
Figure 1:
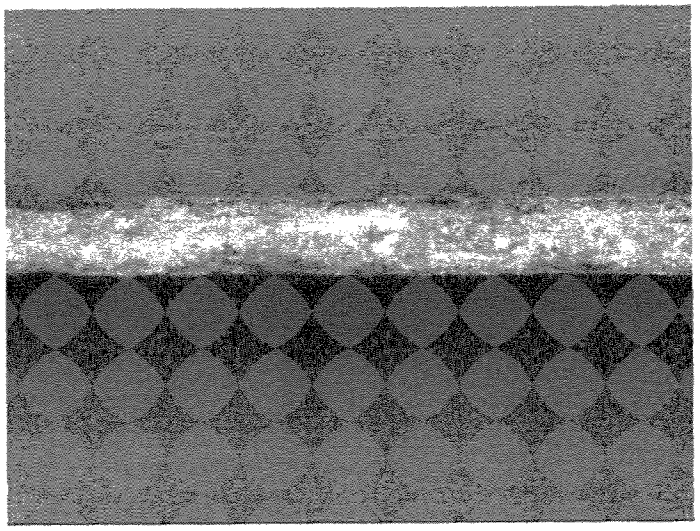

The present inventors have found a way to attain equal or better print density/dry time at much lower additive levels, in some instances at application levels (pickup=lbs/ton) that are one-half to one-third of those typically used at the size press. The present inventors have surprisingly found that the effective surface concentration of water soluble divalent metal salts, e.g., calcium chloride can be maintained or increased by incorporating the salt-containing sizing into an I-beam structure. It has also now been found that the further addition of surface pigments such as GCC, PCC, and the like synergistically improves the gamut volume and dry time.

The formation of the I-beam structure is best carried out with a metered size press, such as rod-metering, using typically high solids formulations, lower volume rods to control pick-ups, and optimum nip pressure to prevent the paper from being compressed. In this way, the placement of the sizing agent is desirably controlled, and the integrity of the I-beam structure is maintained.

The higher solids, lower pickup, or higher viscosity of the size press formulation advantageously allows greater variation in nip pressures with less impact in the papermaking process.

The recording sheet may suitably contain an "effective amount" of the divalent water soluble metal salt in contact with at least one surface of the substrate. As used herein, an "effective amount" is an amount which is sufficient to form an I-beam structure when considered with the accompanying sizing agent or to enhance image dry time. This total amount of divalent water soluble metal salt in the substrate can vary widely, provided that the desired I-beam structure is maintained or achieved. Usually, this amount is at least 0.02 $g/m^2$, although lower or higher amounts can be used. The amount of divalent water soluble metal salt is preferably from about 0.04 $g/m^2$ to about 3 $g/m^2$, which ranges includes all values and subranges therebetween, including 0.04, 0.05, 0.06, 0.07, 0.08, 0.09, 0.1, 0.2, 0.3, 0.4, 0.5, 0.6, 0.7, 0.8, 0.9, 1, 1.5, 2, 2.5, and 3 $g/m^2$ or any combination thereof, and most preferably from about 0.04 $g/m^2$ to about 2.0 $g/m^2$. In the embodiments of choice, the amount of divalent water soluble metal salt is preferably from about 0.04 $g/m^2$ to about 1.0 $g/m^2$.

Any water soluble divalent metal salt can be used in the practice of this invention. Suitable divalent water soluble metal salts include but are not limited to compounds containing divalent calcium, magnesium, barium, zinc, or any combination of these. The counter ions (anions) may be simple or complex and may vary widely. Illustrative of such materials are calcium chloride, magnesium chloride, and calcium acetate. Preferred divalent water soluble metal salts for use in the practice of this invention are water soluble calcium salts, especially calcium chloride.

In one embodiment, the divalent metal salt may be a mineral or organic acid salt of a divalent cationic metal ion, or a combination thereof. In one embodiment, the water soluble metal salt may include a halide, nitrate, chlorate, perchlorate, sulfate, acetate, carboxylate, hydroxide, nitrite, or the like, or combinations thereof, of calcium, magnesium, barium, zinc (II), or the like, or combinations thereof. Some examples of divalent metal salts include, without limitation, calcium chloride, magnesium chloride, magnesium bromide, calcium bromide, barium chloride, calcium nitrate, magnesium nitrate, barium nitrate, calcium acetate, magnesium acetate, barium acetate, calcium magnesium acetate, calcium propionate, magnesium propionate, barium propionate, calcium formate, calcium 2-ethylbutanoate, calcium nitrite, calcium hydroxide, zinc chloride, zinc acetate, and combinations thereof. Mixtures or combinations of salts of different divalent metals, different anions, or both are possible. The relative weight of the divalent cationic metal ion in the divalent metal salt may be maximized, if desired, with respect to the anion in the salt to provide enhanced efficiencies based on the total weight of applied salt. Consequently, for this reason, for example, calcium chloride may be preferred over calcium bromide. Equivalent performance in print properties is expected when equivalent dosages of divalent metal cations in the divalent metal salts are present in the paper, expressed on a molar basis.

In one embodiment, the divalent metal salt is soluble in the amount used in the aqueous sizing formulation. In one embodiment, it is soluble at about pH 6 to about pH 9. The aqueous sizing medium may be in the form of an aqueous solution, emulsion, dispersion, or a latex or colloidal composition, and the term "emulsion" is used herein, as is customary in the art, to mean either a dispersion of the liquid-in-liquid type or of the solid-in-liquid type, as well as latex or colloidal composition.

In one embodiment, the water solubility of the divalent metal salt may suitably range from slightly or moderately soluble to soluble, measured as a saturated aqueous solution of the divalent metal salt at room temperature. The water solubility may range from 0.01 mol/L and upwards. This range includes all values and subranges therebetween, including 0.01, 0.05, 0.1, 0.5, 1, 1.5, 2, 5, 7, 10, 15, 20, 25 mol/L and higher. In one embodiment, the water solubility of the divalent metal salt is 0.1 mol/L or greater.

The paper substrate suitably comprises a plurality of cellulosic fibers. The type of cellulosic fiber is not critical, and any such fiber known or suitable for use in paper making can be used. For example, the substrate can made from pulp fibers derived from hardwood trees, softwood trees, or a combination of hardwood and softwood trees. The fibers may be prepared for use in a papermaking furnish by one or more known or suitable digestion, refining, and/or bleaching operations such as, for example, known mechanical, thermomechanical, chemical and/or semichemical pulping and/or other well known pulping processes. The term, "hardwood pulps" as may be used herein include fibrous pulp derived from the woody substance of deciduous trees (angiosperms) such as birch, oak, beech, maple, and eucalyptus. The term, "softwood pulps" as may be used herein include fibrous pulps derived from the woody substance of coniferous trees (gymnosperms) such as varieties of fir, spruce, and pine, as for example loblolly pine, slash pine, Colorado spruce, balsam fir and Douglas fir. In some embodiments, at least a portion of the pulp fibers may be provided from non-woody herbaceous plants including, but not limited to, kenaf, hemp, jute, flax, sisal, or abaca, although legal restrictions and other considerations may make the utilization of hemp and other fiber sources impractical or impossible. Either bleached or unbleached pulp fiber may be utilized. Recycled pulp fibers are also suitable for use.

The paper substrate may suitably contain from 1 to 99 wt % of cellulosic fibers based upon the total weight of the substrate. In one embodiment, the paper substrate may contain from 5 to 95 wt % of cellulosic fibers based upon the total weight of the substrate. These ranges include any and all values and subranges therebetween, for example, 1, 5, 10, 15, 20, 25, 30, 35, 40, 45, 50, 55, 60, 65, 70, 75, 80, 85, 90, 95 and 99 wt %.

The paper substrate may optionally contain from 1 to 100 wt % cellulosic fibers originating from softwood species based upon the total amount of cellulosic fibers in the paper substrate. In one embodiment, the paper substrate may contain 10 to 60 wt % cellulosic fibers originating from softwood species based upon the total amount of cellulosic fibers in the paper substrate. These ranges include 1, 2, 5, 10, 15, 20, 25, 30, 35, 40, 45, 50, 55, 60, 65, 70, 75, 80, 85, 90, 95, and 100 wt % and any and all ranges and subranges therein, based upon the total amount of cellulosic fibers in the paper substrate.

In one embodiment, the paper substrate may alternatively or overlappingly contain from 0.01 to 99 wt % fibers from softwood species, based on the total weight of the paper substrate. In another embodiment, the paper substrate may contain from 10 to 60 wt % fibers from softwood species based upon the total weight of the paper substrate. These ranges include any and all values and subranges therein. For example, the paper substrate may contain not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 99 wt % softwood based upon the total weight of the paper substrate.

All or part of the softwood fibers may optionally originate from softwood species having a Canadian Standard Freeness (CSF) of from 300 to 750. In one embodiment, the paper substrate contains fibers from a softwood species having a CSF from 400 to 550. These ranges include any and all values and subranges therebetwen, for example, 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, and 750 CSF. Canadian Standard Freeness is as measured by TAPPI T-227 standard test.

The paper substrate may optionally contain from 1 to 100 wt % cellulosic fibers originating from hardwood species based upon the total amount of cellulosic fibers in the paper substrate. In one embodiment, the paper substrate may contain from 30 to 90 wt % cellulosic fibers originating from hardwood species, based upon the total amount of cellulosic fibers in the paper substrate. These ranges include 1, 2, 5, 10, 15, 20, 25, 30, 35, 40, 45, 50, 55, 60, 65, 70, 75, 80, 85, 90, 95, and 100 wt %, and any and all values and subranges therein, based upon the total amount of cellulosic fibers in the paper substrate.

In one embodiment, the paper substrate may alternatively or overlappingly contain from 0.01 to 99 wt % fibers from hardwood species, based upon the total weight of the paper substrate. In another embodiment, the paper substrate may alternatively or overlappingly contain from 60 to 90 wt % fibers from hardwood species, based upon the total weight of the paper substrate. These ranges include any and all values and subranges therebetween, including not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95, 99 and 99 wt %, based upon the total weight of the paper substrate.

All or part of the hardwood fibers may optionally originate from hardwood species having a Canadian Standard Freeness of from 300 to 750. In one embodiment, the paper substrate may contain fibers from hardwood species having CSF values of from 400 to 550. These ranges include 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, and 750 CSF, and any and all ranges and subranges therein.

The paper substrate may optionally contain less refined fibers, for example, less refined softwood fibers, less refined hardwood, or both. Combinations of less refined and more refined fibers are possible. In one embodiment, the paper substrate contains fibers that are at least 2% less refined than that of fibers used in conventional paper substrates. This range includes all values and subranges therebetween, including at least 2, 5, 10, 15, and 20%. For example, if a conventional paper contains fibers, softwood and/or hardwood, having a Canadian Standard Freeness of 350, then, in one embodiment, the paper substrate may contain fibers having a CSF of 385 (i.e. refined 10% less than conventional) and still perform similar, if not better, than the conventional paper. Nonlimiting examples of some performance qualities of the paper substrate are discussed below. Examples of some reductions in refining of hardwood and/or softwood fibers include, but are not limited to: 1) from 350 to at least 385 CSF; 2) from 350 to at least 400 CSF; 3) from 400 to at least 450 CSF; and 4) from 450 to at least 500 CSF. In some embodiments, the reduction in fiber refinement may be at least 2, 3, 4, 5, 6, 7, 8, 9, 10, 11, 12, 13, 14, 15, 16, 17, 18, 19, 20, and 25% reduction in refining compared to those fibers in conventional paper substrates.

When the paper substrate contains both hardwood fibers and softwood fibers, the hardwood/softwood fiber weight ratio may optionally range from 0.001 to 1000. In one embodiment, the hardwood/softwood ratio may range from 90/10 to 30/60. These ranges include all values and subranges therebetween, including 0.001, 0.002, 0.005, 0.01, 0.02, 0.05, 0.1, 0.2, 0.5, 1, 2, 5, 10, 15, 20, 25, 30, 35, 40, 45, 50, 55, 60, 65, 70, 75, 80, 85, 90, 95, 100, 200, 300, 400, 500, 600, 700, 800, 900, and 1000.

The softwood fibers, hardwood fibers, or both may be optionally modified by physical and/or chemical processes. Examples of physical processes include, but are not limited to, electromagnetic and mechanical processes. Examples of electrical modifications include, but are not limited to, processes involving contacting the fibers with an electromagnetic energy source such as light and/or electrical current. Examples of mechanical modifications include, but are not limited to, processes involving contacting an inanimate object with the fibers. Examples of such inanimate objects include those with sharp and/or dull edges. Such processes also involve, for example, cutting, kneading, pounding, impaling, and the like, and combinations thereof.

Nonlimiting examples of chemical modifications include conventional chemical fiber processes such as crosslinking and/or precipitation of complexes thereon. Other examples of suitable modifications of fibers include those found in U.S. Pat. Nos. 6,592,717, 6,592,712, 6,582,557, 6,579,415, 6,579,414, 6,506,282, 6,471,824, 6,361,651, 6,146,494, H1,704, 5,731,080, 5,698,688, 5,698,074, 5,667,637, 5,662,773, 5,531,728, 5,443,899, 5,360,420, 5,266,250, 5,209,953, 5,160,789, 5,049,235, 4,986,882, 4,496,427, 4,431,481, 4,174,417, 4,166,894, 4,075,136, and 4,022,965, the entire contents of each of which are hereby incorporated, independently, by reference. Still other examples of suitable modifications of fibers may be found in U.S. Application Nos. 60/654,712, filed Feb. 19, 2005, and 11/358,543, filed Feb. 21, 2006, which may include the addition of optical brighteners (i.e. OBAs) as discussed therein, the entire contents of each of which are hereby incorporated, independently, by reference.

The paper substrate may optionally include "fines." "Fines" fibers are typically those fibers with average lengths of not more than about 100 μm. Sources of "fines" may be found in SaveAll fibers, recirculated streams, reject streams, waste fiber streams, and combinations thereof. The amount of "fines" present in the paper substrate can be modified, for example, by tailoring the rate at which streams are added to the paper making process. In one embodiment, the average lengths of the fines are not more than about 5, 10, 15, 20, 25, 30, 35, 40, 45, 50, 55, 60, 65, 70, 75, 80, 85, 90, 95, and 100 μm, including any and all ranges and subranges therein.

If used, the "fines" fibers may be present in the paper substrate together with hardwood fibers, softwood fibers, or both hardwood and softwood fibers.

The paper substrate may optionally contain from 0.01 to 100 wt % fines, based on the total weight of the paper substrate. In one embodiment, the paper substrate may contain from 0.01 to 50 wt % fines, based upon the total weight of the substrate. These ranges include all values and subranges therebetween, including not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 100 wt % fines, based upon the total weight of the paper substrate.

In one embodiment, the paper substrate may alternatively or overlappingly contain from 0.01 to 100 wt % fines, based upon the total weight of the fibers in the paper substrate. This range includes all values and subranges therebetween, including not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 100 wt % fines, based upon the total weight of the fibers in by the paper substrate.

The recording sheet contains at least one sizing agent, which cooperates with the paper substrate to form an I-beam structure. So long as it contains at least one water soluble divalent metal salt, the sizing agent is not particularly limited, and any conventional papermaking sizing agent may be used. The sizing agent may be nonreactive, reactive, or a combination of nonreactive and reactive. The sizing agent may, optionally and if desired, impart a moisture or water-resistance in varying degrees to the paper substrate. Non-limiting examples of sizing agents can be found in the "Handbook for Pulp and Paper Technologists" by G. A. Smook (1992), Angus Wilde Publications, which is hereby incorporated, in its entirety, by reference. Preferably, the sizing agent is a surface sizing agent. Preferable examples of sizing agents are starch, alkyl ketene dimer (AKD), alkenyl ketene dimer (ALKD), alkenyl succinic anhydride (ASA), ASA/ALKD, styrene acrylic emulsion (SAE) polyvinyl alcohol (PVOH), polyvinylamine, alginate, carboxymethyl cellulose, etc. However, any sizing agent may be used. See, for example, the sizing agents disclosed in U.S. Pat. No. 6,207,258, the entire contents of which are hereby incorporated by reference.

Many nonreactive sizing agents are known in the art. Examples include, without limitation, BASOPLAST® 335D nonreactive polymeric surface size emulsion from BASF Corporation (Mt. Olive, N.J.), FLEXBONDX® 325 emulsion of a copolymer of vinyl acetate and butyl acrylate from Air Products and Chemicals, Inc. (Trexlertown, Pa.), and PENTAPRINT® nonreactive sizing agents (disclosed for example in Published International Patent Application Publication No. WO 97/45590, published Dec. 4, 1997, corresponding to U.S. patent application Ser. No. 08/861,925, filed May 22, 1997, the entire contents of which are hereby incorporated by reference) from Hercules Incorporated (Wilmington, Del.), to name a few.

For papermaking carried out under alkaline pH manufacturing conditions, sizing agents based on alkyl ketene dimers (AKDs) or alkenyl ketene dimers (ALKDs) or multimers and alkenyl succinic anhydride (ASA) sizing agents may be suitably used. Combinations of these and other sizing agents may also be employed.

Ketene dimers used as sizing agents for papermaking are well known. AKDs, containing one β-lactone ring, are typically prepared by the dimerization of alkyl ketenes made from two fatty acid chlorides. Commercial alkyl ketene dimer sizing agents are often prepared from palmitic and/or stearic fatty acids, e.g. Hercon® and Aquapel® sizing agents (both from Hercules Incorporated).

Alkenyl ketene dimer sizing agents are also commercially available, e.g. Precis® sizing agents (Hercules Incorporated).

U.S. Pat. No. 4,017,431, the entire contents of which are hereby incorporated by reference, provides a nonlimiting exemplary disclosure of AKD sizing agents with wax blends and water soluble cationic resins.

Ketene multimers containing more than one β-lactone ring may also be employed as sizing agents.

Sizing agents prepared from a mixture of mono- and dicarboxylic acids, have been disclosed as sizing agents for paper in Japanese Kokai Nos. 168991/89 and 168992/89.

European patent application Publication No. 0 629 741 A1 discloses alkyl ketene dimer and multimer mixtures as sizing agents in paper used in high speed converting and reprographic machines. The alkyl ketene multimers are made from the reaction of a molar excess of monocarboxylic acid, typically a fatty acid, with a dicarboxylic acid. These multimer compounds are solids at 25° C.

European patent application Publication No. 0 666 368 A2 and Bottorff et al. in U.S. Pat. No. 5,685,815, the entire contents of which are hereby incorporated by reference, disclose paper for high speed or reprographic operations that is internally sized with an alkyl or alkenyl ketene dimer and/or multimer sizing agent. The preferred 2-oxetanone multimers are prepared with fatty acid to diacid ratios ranging from 1:1 to 3.5:1.

Commercial ASA-based sizing agents are dispersions or emulsions of materials that may be prepared by the reaction of maleic anhydride with an olefin ($C_{14}$-$C_{18}$).

Examples of hydrophobic acid anhydrides useful as sizing agents for paper include: (i) rosin anhydride (see U.S. Pat. No. 3,582,464, for example, the entire contents of which are hereby incorporated by reference);

(ii) anhydrides having the structure (I):

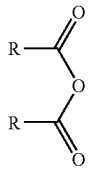

where each R is the same or a different hydrocarbon radical; and (iii) cyclic dicarboxylic acid anhydrides, such as those having the structure (II):

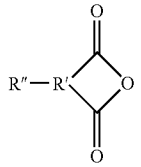

where R' represents a dimethylene or trimethylene radical and where R" is a hydrocarbon radical.

Some examples of anhydrides of formula (I) include myristoyl anhydride; palmitoyl anhydride; olcoyl anhydride; and stearoyl anhydride.

Examples of substituted cyclic dicarboxylic acid anhydrides falling within the above formula (II) include substituted succinic, glutaric anhydrides, i- and n-octadecenyl succinic acid anhydride; i- and n-hexadecenyl succinic acid anhydride; i- and n-tetradecenyl succinic acid anhydride, dodecyl succinic acid anhydride; decenyl succinic acid anhydride; ectenyl succinic acid anhydride; and heptyl glutaric acid anhydride.

Other examples of nonreactive sizing agents include a polymer emulsion, a cationic polymer emulsion, an amphoteric polymer emulsion, polymer emulsion wherein at least one monomer is selected from the group including styrene, α-methylstyrene, acrylate with an ester substituent with 1 to 13 carbon atoms, methacrylate having an ester substituent with 1 to 13 carbon atoms, acrylonitrile, methacrylonitrile, vinyl acetate, ethylene and butadiene; and optionally including acrylic acid, methacrylic acid, maleic anhydride, esters of maleic anhydride or mixtures thereof, with an acid number less than about 80, and mixtures thereof. If desired, the polymer emulsion may stabilized by a stabilizer predominantly including degraded starch, such as that disclosed, for example, in U.S. Pat. Nos. 4,835,212, 4,855,343, and 5,358,998, the entire contents of each of which are hereby incorporated by reference. If desired, a polymer emulsion may be used in which the polymer has a glass transition temperature of about −15° C. to about 50° C.

For traditional acid pH papermaking conditions, nonreactive sizing agents in the form of dispersed rosin sizing agents may be suitably used. Dispersed rosin sizing agents are well known. Nonlimiting examples of rosin sizing agents are disclosed in, for example, U.S. Pat. Nos. 3,966,654 and 4,263,182, the entire contents of each of which are hereby incorporated by reference.

The rosin may be any modified or unmodified, dispersible or emulsifiable rosin suitable for sizing paper, including unfortified rosin, fortified rosin and extended rosin, as well as rosin esters, and mixtures and blends thereof. As used herein, the term "rosin" means any of these forms of dispersed rosin useful in a sizing agent.

The rosin in dispersed form is not particularly limited, and any of the commercially available types of rosin, such as wood rosin, gum rosin, tall oil rosin, and mixtures of any two or more, in their crude or refined state, may be used. In one embodiment, tall oil rosin and gum rosin are used. Partially hydrogenated rosins and polymerized rosins, as well as rosins that have been treated to inhibit crystallization, such as by heat treatment or reaction with formaldehyde, may also be employed.

The fortified rosin is not particularly limited. One example of such a rosin includes the adduct reaction product of rosin and an acidic compound containing the

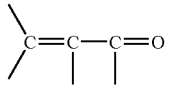

group and is derived by reacting rosin and the acidic compound at elevated temperatures of from about 150° C. to about 210° C.

The amount of acidic compound employed will be that amount which will provide fortified rosin containing from about 1% to about 16% by weight of adducted acidic compound based on the weight of the fortified rosin. Methods of preparing fortified rosin are well known to those skilled in the art. See, for example, the methods disclosed and described in U.S. Pat. Nos. 2,628,918 and 2,684,300, the entire contents of each of which are hereby incorporated by reference.

Examples of acidic compounds containing the

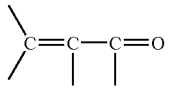

group that can be used to prepare the fortified rosin include the α-β-unsaturated organic acids and their available anhydrides, specific examples of which include fumaric acid, maleic acid, acrylic acid, maleic anhydride, itaconic acid, itaconic anhydride, citraconic acid and citraconic anhydride. Mixtures of acids can be used to prepare the fortified rosin if desired.

Thus, for example, a mixture of the acrylic acid adduct of rosin and the fumaric acid adduct can be used to prepare a dispersed rosin sizing agent. Also, fortified rosin that has been substantially completely hydrogenated after adduct formation can be used.

Rosin esters may also be used in the dispersed rosin sizing agents. Suitable exemplary rosin esters may be rosin esterified as disclosed in U.S. Pat. No. 4,540,635 (Ronge et al.) or U.S. Pat. No. 5,201,944 (Nakata et al.), the entire contents of each of which are hereby incorporated by reference.

The unfortified or fortified rosin or rosin esters can be extended if desired by known extenders such as waxes (particularly paraffin wax and microcrystalline wax); hydrocarbon resins including those derived from petroleum hydrocarbons and terpenes; and the like. This may be suitably accomplished by melt blending or solution blending with the rosin or fortified rosin from about 10% to about 100% by weight, based on the weight of rosin or fortified rosin, of the extender.

Blends of fortified rosin and unfortified rosin; blends of fortified rosin, unfortified rosin, rosin esters and rosin extender can be used. Blends of fortified and unfortified rosin may include, for example, about 25% to 95% fortified rosin and about 75% to 5% unfortified rosin. Blends of fortified rosin, unfortified rosin, and rosin extender may include, for example, about 5% to 45% fortified rosin, 0 to 50% rosin, and about 5% to 90% rosin extender.

Hydrophobic organic isocyanates, e.g., alkylated isocyanates, may also be used as sizing agents.

Other conventional paper sizing agents include alkyl carbamoyl chlorides, alkylated melamines such as stearylated melamines, and styrene acrylates.

Mixtures of sizing agents are possible.

An external sizing agent or both internal and surface sizing agents may be used. When both are present, they may be present in any weight ratio and may be the same and/or different. In one embodiment, the weight ratio of surface sizing agent to internal sizing agent is from 50/50 to 100/0, more preferably from 75/25 to 100/0 surface/internal sizing agent. This range includes 50/50, 55/45, 60/40, 65/35, 70/30, 75/25, 80/20, 85/15, 90/10, 95/5 and 100/0, including any and all ranges and subranges therein. A preferred example of an internal sizing agent is alkenyl succinic anhydride (ASA).

When starch is used as a sizing agent, starch may be modified or unmodified. Examples of starch may be found in the "Handbook for Pulp and Paper Technologists" by G. A. Smook (1992), Angus Wilde Publications, mentioned above. Preferable examples of modified starches include, for example, oxidized, cationic, ethylated, hydroethoxylated, etc. In addition, the starch may come from any source, preferably potato and/or corn. Most preferably, the starch source is corn.

In one embodiment, a mixture comprising calcium chloride and one or more starches is in contact with at least one surface of the substrate. Illustrative of useful starches include naturally occurring carbohydrates synthesized in corn, tapioca, potato and other plants by polymerization of dextrose units. All such starches and modified forms thereof such as starch acetates, starch esters, starch ethers, starch phosphates, starch xanthates, anionic starches, cationic starches, oxidized starches, and the like which can be derived by reacting the starch with a suitable chemical or enzymatic reagent can be used. If desired, starches may be prepared by known techniques or obtained from commercial sources. For example, one example of a commercial starches include Ethylex 2035 from A. E. Staley, PG-280 from Penford Products, oxidized corn starches from ADM, Cargill, and Raisio, and enzyme converted starches such as Amyzet 150 from Amylum.

Modified starches may be used. Non-limiting examples of a type of modified starches include cationic modified chemically modified starches such as ethylated starches, oxidized starches, and AP and enzyme converted Pearl starches. Most preferred are chemically modified starches such as ethylated starches, oxidized starches, and AP and enzyme converted Pearl starches.

In one embodiment, a water soluble metal salt, for example, calcium chloride, and Ethylex 2035 starch are used in a sizing formulation applied to both sides of a sheet of paper, and an improved dry time of the sheet is obtained when the weight ratio of the calcium chloride to the starch is equal to or greater than about 0.5 to about 20%. This range includes all values and subranges therebetween, including 0.5, 0.6, 0.7, 0.8, 0.9, 1, 1.5, 2, 3, 4, 5, 6, 7, 8, 9, 10, 11, 12, 13, 14, 15, 16, 17, 18, 19, and 20%, and any combination thereof. In one embodiment, the weight ratio of the calcium chloride to the starch may range from about 0.5 to about 18%. In another embodiment, the weight ratio may range from about 0.75 to about 17%. In another embodiment, the weight ratio may range from about 1% to about 16%. The weight ratios of the calcium chloride to the starch may be one-half of those stated if the starch/salt mixture is only applied to one side of the paper, and starch without salt is applied to the other side. In this case, the improved print properties would only be expected on the side of the paper containing the salt.

The amount of divalent water soluble metal salt and one or more starches in and/or on the substrate may vary widely, and any conventional amount can be used. One advantage of the invention, however, is that reduced amounts of sizing agent and/or water soluble divalent metal salt may be used, if desired. In one embodiment, the amount of the water soluble divalent metal salt in and/or on the substrate is at least about 0.02 g/m$^2$ of recording sheet, although higher and lower amounts can be used. The amount is preferably at least about 0.03 g/m$^2$, more preferably at least about 0.04 g/m$^2$ and most preferably from about 0.04 g/m$^2$ to about 3.0 g/m$^2$. These preferred ranges include all values and subranges therebetween, including about 0.02, 0.03, 0.04, 0.05, 0.06, 0.07, 0.08, 0.09, 0.1, 0.2, 0.3, 0.4, 0.5, 0.6, 0.7, 0.8, 0.9, 1.0, 1.2, 1.4, 1.6, 1.8, 2.0, 2.2, 2.4, 2.6, 2.8, and 3.0 g/m$^2$, and any combination thereof.

When polyvinyl alcohol is used as a sizing agent, it may have any % hydrolysis. Preferable polyvinyl alcohols are those having a % hydrolysis ranging from 100% to 75%. The % hydrolysis of the polyvinyl alcohol may be 75, 76, 78, 80, 82, 84, 85, 86, 88, 90, 92, 94, 95, 96, 98, and 100% hydrolysis, including any and all ranges and subranges therein.

The paper substrate may contain PVOH at any wt %. Preferably, when PVOH is present, it is present at an amount from 0.001 wt % to 100 wt % based on the total weight of sizing agent contained in and/or on the substrate. This range includes 0.001, 0.002, 0.005, 0.006, 0.008, 0.01, 0.02, 0.03, 0.04, 0.05, 0.1, 0.2, 0.4, 0.5, 0.6, 0.7, 0.8, 0.9, 1, 2, 4, 5, 6, 8, 10, 12, 14, 15, 16, 18, 20, 25, 30, 35, 40, 45, 50, 55, 60, 65, 70, 75, 80, 85, 90, 95, and 100 wt % based on the total weight of sizing agent in the substrate, including any and all ranges and subranges therein.

The sizing agent may also include one or more optional additives such as binders, pigments, thickeners, defoamers, surfactants, slip agents, dispersants, optical brighteners, dyes, and preservatives, which are well-known. Examples of pigments include, but are not limited to, clay, calcium carbonate, calcium sulfate hemihydrate, and calcium sulfate dehydrate, chalk, GCC, PCC, and the like. A preferable pigment is calcium carbonate with the preferred form being precipitated calcium carbonate. Examples of binders include, but are not limited to, polyvinyl alcohol, Amres (a Kymene type), Bayer Parez, polychloride emulsion, modified starch such as hydroxyethyl starch, starch, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate. Other optional additives include, but are not limited to silicas such as colloids and/or sols. Examples of silicas include, but are not limited to, sodium silicate and/or borosilicates. Other additives which may be used include one or more solvents such as, for example, water. Combinations of additives are possible.

A majority of the total amount of sizing agent is preferably located at or near the outside surface or surfaces (in the case of the sizing applied to both surfaces) of the paper substrate. The paper substrate of the present invention contains the sizing agent such that they (the substrate and the sizing agent) cooperate to form an I-beam structure. In this regard, it is not required that the sizing agent interpenetrate with the cellulosic fibers of the substrate. However, if the coating layer and the cellulose fibers interpenetrate, it will create a paper substrate having an interpenetration layer, which is within the ambit of the present invention.

The interpenetration layer of the paper substrate defines a region in which at least the sizing solution penetrates into and is among the cellulose fibers. The interpenetration layer may be from 1 to 99% of the entire cross section of at least a portion of the paper substrate, including 1, 2, 5, 10, 15, 20, 25, 30, 35, 40, 45, 50, 55, 60, 65, 70, 75, 80, 85, 90, 95, and 99% of the paper substrate, including any and all ranges and subranges therein. Such an embodiment may be made, for example, when a sizing solution is added to the cellulose fibers prior to a coating method and may be combined with a subsequent coating method if required. Addition points may be at the size press, for example.

Preferably, the cross-sectional thickness of the interpenetration layer is minimized. Alternatively, or additionally, the concentration of the sizing agent preferably increases as one moves (in the z-direction normal to the plane of the substrate) from the interior portion towards the surface of the paper substrate. Therefore, the amount of sizing agent present towards the top and/or bottom outer surfaces of the substrate is preferably greater than the amount of sizing agent present towards the inner middle of paper substrate. Alternatively, a majority percentage of the sizing agent may preferably be located at a distance from the outside surface of the substrate that is equal to or less than 25%, more preferably 10%, of the total thickness of the substrate. This aspect may also be known as the $Q_{total}$, which is measured by known methodologies outlined, for example, in U.S. Patent Publication No. 2008/0035292, published Feb. 14, 2008, the entire contents of which are hereby incorporated by reference. If $Q_{total}$ is equal to 0.5, then the sizing agent is approximately evenly distributed throughout the paper substrate. If $Q_{total}$ is greater than 0.5, then there is more sizing agent towards the central portion (measured by the z-direction normal to the plane of the substrate) of the paper substrate than towards the paper substrate's surface or surfaces. If $Q_{total}$ is less than 0.5, then there is less sizing agent towards the central portion of the paper substrate than towards the paper substrate's surface or surfaces. In light of the above, the paper substrate preferably has a $Q_{total}$ that is less than 0.5, preferably less than 0.4, more preferably less than 0.3, most preferably less than 0.25. Accordingly the $Q_{total}$ of the paper substrate may be from 0 to less than 0.5. This range includes 0, 0.001, 0.002, 0.005, 0.01, 0.02, 0.05, 0.1, 0.15, 0.2, 0.25, 0.3, 0.35, 0.4, 0.45, and 0.49, including any and all ranges and subranges therein.

As noted above, the determination of Q may be suitably carried out according to the procedures in U.S. Patent Publication 2008/0035292, published Feb. 14, 2008.

In essence, Q is a measurement of the amount of the sizing agent as one progresses from the outside edges towards the middle of the sheet from a cross section view. It is understood herein that the Q may be any Q such that it represents an enhanced capacity to have sizing agent towards the outside surfaces of the cross section of the sheet and Q may be selected (using any test) such that any one or more of the above and below-mentioned characteristics of the paper substrate are provided (e.g. Internal Bond, Hygroexpansivity, IGT Pick, and/or IGT VPP delamination, etc).

Of course, there are other methods to measuring the equivalent of Q. In one embodiment, any Q measurement, or a similar method of measuring the ratio of the amount of sizing agent towards the core of the substrate compared to the amount of sizing agent towards the outside surface or surfaces of the substrate is acceptable. In a preferred embodiment, this ratio is such that as much sizing agent as possible is located towards the outside surfaces of the substrate, thereby minimizing the interpenetration zone and/or minimizing the amount of sizing agent located in the interpenetration layer, is achieved. It is also preferable that this distribution of sizing agent occurs even at very high level of sizing agent loadings, preferably external sizing agent loadings, within and/or onto the substrate. Thus, it is desirable to control the amount of sizing agent located within the interpenetration layer as more and more external sizing agent is loaded thereon its surface by either minimizing the concentration of the sizing agent in this interpenetration layer or by reducing the thickness of the interpenetration layer itself. In one embodiment, the characteristics of the recording sheet and/or paper substrate of the present invention are those that can be achieved by such control of the sizing agent. While this controlled loading of the sizing agent can occur in any manner, it is preferable that the sizing agent is loaded or applied via a size press.

A further example of a manner to measure the amount of the sizing agent as one progresses from the outside edges towards the middle of the sheet from a cross section is found in Example 10 by splitting a paper sheet and measuring the amount of the sizing agent present in the each split portion of the sheet.

Irrespective of the manner in which one measures the amount of the sizing agent as one progresses from the outside edges towards the middle of the sheet from a cross section view, one embodiment is that the sizing agent is a divalent metal salt and has an effective concentration located a distance that is within 25% from at least one surface of said substrate and at least a majority, preferably 75%, most preferably 100% of a total concentration of the divalent metal salt is located a distance that is within 25% from at least one surface of said substrate, the effective concentration of divalent metal salt producing a black optical density that is at least 1.15. In this embodiment, the effective concentration of the divalent metal salt may be at least 2,500 ppm, preferably at least 6000 ppm, most preferably at least 12,000 ppm.

The effective concentration of the divalent metal salt may be located a distance that is within 25%, 20%, 15%, 10%, and 5% from at least one surface of said substrate, including all ranges and subranges therein.

At least 51%, 55%, 60%, 65%, 70%, 75%, 80%, 85%, 90%, 95% and 100% of the total concentration of the divalent metal salt is located a distance that is within 25% form at least one surface of the substrate, including any and all ranges and subranges therein.

The effective concentration of divalent metal ion is such that it provides a black optical density (as described above) of at least 1.0, 1.1, 1.15, 1.2, 1.25, 1.3, 1.35, 1.4, 1.45, 1.5, and 1.6, including any and all ranges and subranges therein.

The effective concentration may be any concentration including, 2500, 3000, 3500, 4000, 4500, 5000, 5500, 6000, 6500, 7000, 7500, 8000, 8500, 9000, 9500, 10000, 10500, 11000, 11500, and 12000 ppm of divalent metal ion, including any and all ranges and subranges therein.

The recording sheet may be made by contacting the sizing agent with the cellulose fibers of the paper substrate. The contacting may occur at acceptable concentration levels of the sizing agent and/or other additives.

The I-beam structure is produced as a result of the selective placement and heavily controlled locality of the sizing agent within and/or on the paper substrate. "I-beam" and performance characteristics thereof are suitably described in U.S. Patent Publication No. 2004/0065423, published Apr. 8, 2004, which is hereby incorporated in its entirety by reference. The determination of whether the sizing agent and the paper substrate cooperate to form an I-beam structure may be easily carried out by one of ordinary skill in the printing arts, given the teachings herein. For example, by staining the recording sheet with iodine and viewing the thus-stained sheet in cross section with an optical microscope, one can readily determine whether an I-beam structure has been achieved.

The recording sheet of the present application may be made by contacting the substrate with an internal and/or surface sizing solution or formulation containing at least one sizing agent. The contacting may occur anytime in the papermaking process including, but not limited to the wet end, head box, size press, water box, and/or coater. Further addition points include machine chest, stuff box, and suction of the fan pump. The cellulose fibers, sizing agent, and/or optional components may be contacted serially, consecutively, and/or simultaneously in any combination with each other. Most preferably, the paper substrate is contacted with the size press formulation at the size press.

The paper substrate may be passed through a size press, where any sizing means commonly known in the art of papermaking is acceptable so long as the I-beam structure is achieved or maintained. The size press, for example, may be a puddle mode size press (e.g. inclined, vertical, horizontal) or metered size press (e.g. blade metered, rod metered). Preferably, the size press is a metered size press.

To prepare the size press formulation, one or more divalent water soluble metal salts may be admixed with one or more sizing agents for example, starches, and one or more optional additives can be dissolved or dispersed in an appropriate liquid medium, preferably water, and can be applied to the substrate.

For example, the size press formulation can be applied with conventional size press equipment having vertical, horizontal or inclined size press configurations conventional used in paper preparation as for example the Symsizer (Valmet) type equipment, a KRK size press (Kumagai Riki Kogyo Co., Ltd., Nerima, Tokyo, Japan) by dip coating. The KRK size press is a lab size press that simulates a commercial size press. This size press is normally sheet fed, whereas a commercial size press typically employs a continuous web.

The amount of water soluble divalent metal salt is not particularly limited. In one embodiment in which a sizing agent is present on both sides of a sheet of paper, the amount ranges from about 8 to about 165, including from about 8 to about 33, moles of cations/ton of paper on a paper having a basis weight equal to 75 gsm. This range includes all values and subranges therebetween, including about 8, 9, 10, 11, 12, 13, 14, 15, 16, 17, 18, 19, 20, 21, 22, 23, 24, 25, 26, 27, 28, 29, 30, 31, 32, 33, 35, 37, 40, 45, 50, 55, 60, 65, 70, 75, 80, 85, 90, 95, 100, 105, 110, 115, 120, 125, 130, 135, 140, 145, 150, 155, 160, and 165 moles of cations/ton of paper This range is equal to a range from about 2.5 to about 165, including from about 2.5 to about 33, moles of cations/ton of paper on a paper having a basis weight equal to 250 gsm. This range includes all values and subranges therebetween, including about 2.5, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 35, 37, 40, 45, 50, 55, 60, 65, 70, 75, 80, 85, 90, 95, 100, 105, 110, 115, 120, 125, 130, 135, 140, 145, 150, 155, 160, and 165 moles of cations/ton of paper. Here, moles of cations is intended to mean moles of divalent cationic metals, whether in the salt form, solvated, or otherwise, or a combination thereof.

In one embodiment, the conditions to ensure that the sizing agent and the paper substrate cooperate to form the I-beam structure are designed to allow a dry pickup of 30 to 150 lbs of starch/ton of paper at 12-50% solids for the size press formulation. Here, lbs/ton is calculated on a paper having a basis weight equal to 75 gsm.

The aforementioned range of starch includes all values and subranges therebetween, including 30, 35, 40, 45, 50, 55, 60, 65, 70, 75, 80, 85, 90, 95, 100, 105, 110, 115, 120, 125, 130, 135, 140, 145, and 150 lbs/ton. Here, lbs/ton is calculated on a paper having a basis weight equal to 75 gsm.

It should be readily apparent that the amounts in lbs/ton and moles/ton may vary in a known manner according to the basis weight of the paper, and the invention is not limited to only paper having a basis weight of 75 gsm.

In one embodiment, wherein when calcium chloride is used as the water soluble divalent metal salt and in which a sizing agent is present on both sides of a sheet of paper, the amount ranges from about 2 to about 8 lbs of $CaCl_2$/ton of paper on a paper having a basis weight equal to 75 gsm. This range includes all values and subranges therebetween, including about 2, 3, 4, 5, 6, 7, and 8 lbs of $CaCl_2$/ton of paper. This range is equal to a range from about 0.6 to 8 lbs of $CaCl_2$/ton of paper on a paper having a basis weight equal to 250 gsm. This range includes all values and subranges therebetween, including 0.6, 1, 2, 3, 4, 5, 6, 7, and 8 lbs of $CaCl_2$/ton of paper.

In one embodiment, the % solids in the size press formulation may suitably range from at least 12-50%. This range includes all values and subranges therebetween, including 12, 13, 14, 15, 16, 17, 18, 19, 20, 21, 22, 23, 24, 25, 30, 35, 40, 45, and 50%.

In one embodiment, the dry pickup of the sizing agent may suitably range from 0.25 to 6 gsm, which range includes all values and subranges therebetween, for example, 0.25, 0.3, 0.4, 0.5, 0.6, 0.7, 0.8, 0.9, 1, 2, 3, 4, 5, and 6 gsm, and any combination thereof.

In one embodiment, the wet film thickness is adjusted to give proper pickup. For example, in one embodiment, the wet film thickness may suitably range from greater than zero to 40 mm. This range includes all values and subranges therebetween, including greater than zero, 1, 2, 3, 4, 5, 6, 7, 8, 9, 10, 15, 16, 17, 18, 19, 20, 25, 30, 35, and 40 microns. In one embodiment, the wet film thickness ranges from 10 to 30 microns. In one embodiment, the wet film thickness ranges from 15 to 25 microns.

In one embodiment, the amount of pigment at the size press (in the sizing formulation) may suitably range from 10 to 80 lbs/ton. This range includes all values and subranges therebetween, including 10, 11, 12, 13, 14, 15, 16, 17, 18, 19, 20, 22, 24, 26, 28, 30, 35, 40, 45, 50, 55, 60, 65, 60, 75 and 80 lbs/ton. Here, lbs/ton is calculated using a basis weight of 20# bond paper (75 gsm).

In one embodiment, the temperature at the size press may suitably range from 100-300° F. This range includes all values and subranges therebetween, including 100, 110, 120, 130, 140, 150, 160, 170, 180, 190, 200, 210, 220, 230, 240, 250, 260, 270, 280, 290, and 300° F.

In one embodiment, a rod-metered size press is used. In such an embodiment, a suitable rod volume may range from 0.000864 $in^2$/in to 0.001637 $in^2$/in. This range includes all values and subranges therebetween, including 0.000865, 0.00087, 0.0009, 0.0010, 0.0015, and 0.001637 $in^2$/in.

When the cellulosic fibers are contacted with the size press formulation at the size press, it is preferred that the viscosity of the sizing solution is from 50 to 500 centipoise using a Brookfield Viscometer, number 2 spindle, at 100 rpm and 150° F. These ranges include all values and subranges therebetween, including 50, 55, 60, 65, 70, 75, 80, 85, 90, 95, 100, 125, 150, 160, 170, 180, 190, 200, 210, 220, 230, 240, 250, 260, 270, 280, 290, 300, 325, 350, 375, 400, 425, and 450 centipoise as measured using a Brookfield Viscometer, number 2 spindle, at 100 rpm and 150° F., including any and all ranges and subranges therein. In one embodiment, the viscosity ranges from 50 to 350 centipoise. In another embodiment, the viscosity ranges from 100 to 500 centipoise.

The paper substrate may be pressed in a press section containing one or more nips. Any pressing means commonly known in the art of papermaking may be utilized. The nips may be, but are not limited to, single felted, double felted, roll, and extended nip in the presses. When the sizing solution containing the sizing agent is contacted with the fibers at the size press to make the paper substrate, the effective nip pressure is not particularly limited so long as integrity of the I-beam structure is maintained. For example, the nip pressure may suitably range from greater than zero to 80 kN/m. This range includes all values and subranges therebetween, including greater than zero, 1, 2, 3, 4, 5, 6, 7, 8, 9, 10, 15, 20, 25, 30, 35, 40, 45, 50, 55, 60, 70, and 80 kN/m, including any and all ranges and subranges therein. In one embodiment, the nip pressure ranges from 30 to 80 kN/m.

The nip width is not particularly limited, and may suitably range from greater than zero to 40 mm. This range includes all values and subranges therebetween, including greater than zero, 1, 2, 3, 4, 5, 6, 7, 8, 9, 10, 15, 16, 17, 18, 19, 20, 25, 30, 35, and 40 mm. In one embodiment, the nip width ranges from 15 to 30 mm.

The rolls of the size press may have a P&J hardness, preferably any P&J hardness. Since there are two rolls, a first roll may have a first hardness, while a second roll may have a second hardness. The roll hardness may suitably range from 0 to 30 P&J hardness. This range includes all values and subranges therebetween, including 0, 1, 2, 3, 4, 5, 6, 7, 8, 9, 10, 15, 20, 25, and 30 P&J hardness. If two rolls are used, they may have the same or different hardnesses. The first hardness and the second hardness may be equal and/or different from one another. As an example, the P&J of a first roll at the size press may have a first hardness that independently ranges from 0 to 30 P&J hardness, while the second roll may have a second hardness that independently ranges from 0 to 30 P&J hardness.

In one embodiment, the conditions at the size press are 12-50% solids, temperature of 140-160° F., viscosity of 50-350 cP, dry pickup of size press formulation 0.25 to 10 gsm, and a wet film thickness suitable for a proper pickup.

In another embodiment, the conditions at the size press are 12-50% solids, temperature of 140-160° F., viscosity of 100-500 cP, dry pickup of size press formulation of 0.25 to 10 gsm, and a wet film thickness suitable for a proper pickup.

The paper substrate may be dried in a drying section. Any drying means commonly known in the art of papermaking may be utilized. The drying section may include and contain a drying can, cylinder drying, Condebelt drying, IR, or other drying means and mechanisms known in the art. The paper substrate may be dried so as to contain any selected amount of water. Preferably, the substrate is dried to contain less than or equal to 10% water.

The paper substrate may be calendered by any commonly known calendaring means in the art of papermaking. More specifically, one could utilize, for example, wet stack calendering, dry stack calendering, steel nip calendaring, hot soft calendaring or extended nip calendering, etc.

The paper substrate may be microfinished according to any process commonly known in the art of papermaking. Microfinishing typically involves frictional processes to finish surfaces of the paper substrate. The paper substrate may be microfinished with or without a calendering applied thereto consecutively and/or simultaneously. Examples of microfinishing processes can be found in U.S. Patent Publication No. 2004/0123966 and references cited therein which are all hereby, in their entirety, herein incorporated by reference.

In one embodiment, the paper substrate comprising the sizing agent may be further coated by any conventional coating layer application means, including impregnation means. A preferred method of applying the coating layer is with an in-line coating process with one or more stations. The coating stations may be any of known coating means commonly known in the art of papermaking including, for example, brush, rod, air knife, spray, curtain, blade, transfer roll, reverse roll, and/or cast coating means, as well as any combination of the same.

The further coated paper substrate may be dried in a drying section. Any drying means commonly known in the art of papermaking and/or coatings may be utilized. The drying section may include and contain IR, air impingement dryers and/or steam heated drying cans, or other drying means and mechanisms known in the coating art.

The further coated substrate may be finished according to any finishing means commonly known in the art of papermaking. Examples of such finishing means, including one or more finishing stations, include gloss calendar, soft nip calendar, and/or extended nip calendar.

These paper substrate and/or recording sheet may be added to any conventional papermaking processes, as well as converting processes, including abrading, sanding, slitting, scoring, perforating, sparking, calendaring, sheet finishing, converting, coating, laminating, printing, etc. Preferred conventional processes include those tailored to produce paper substrates capable to be utilized as coated and/or uncoated paper products, board, and/or substrates. Textbooks such as those described in the "Handbook for Pulp and Paper Technologists" by G. A. Smook (1992), Angus Wilde Publications, which is hereby incorporated, in its entirety, by reference.

The recording sheet and/or paper substrate may also include one or more optional substances such as retention aids, binders, fillers, thickeners, and preservatives. Examples of fillers (some of which may also function as pigments as defined above) include, but are not limited to, clay, calcium carbonate, calcium sulfate hemihydrate, and calcium sulfate dehydrate, chalk, GCC, PCC, and the like. Examples of binders include, but are not limited to, polyvinyl alcohol, Amres (a Kymene type), Bayer Parez, polychloride emulsion, modified starch such as hydroxyethyl starch, starch, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate. Other optional substances include, but are not limited to silicas such as colloids and/or sols. Examples of silicas include, but are not limited to, sodium silicate and/or borosilicates. Another example of optional substances are solvents including but not limited to solvents such as water. Combinations of optional substances are possible.

The recording sheet of the present invention may contain from 0.001 to 20 wt % of the optional substances based on the total weight of the substrate, preferably from 0.01 to 10 wt %, most preferably 0.1 to 5.0 wt %, of each of at least one of the optional substances. This range includes 0.001, 0.002, 0.005, 0.006, 0.008, 0.01, 0.02, 0.03, 0.04, 0.05, 0.1, 0.2, 0.4, 0.5, 0.6, 0.7, 0.8, 0.9, 1, 2, 4, 5, 6, 8, 10, 12, 14, 15, 16, 18, and 20 wt % based on the total weight of the substrate, including any and all ranges and subranges therein.

Other conventional additives that may be present include, but are not limited to, wet strength resins, internal sizes, dry strength resins, alum, fillers, pigments and dyes. The substrate may include bulking agents such as expandable microspheres, pulp fibers, and/or diamide salts.

The paper substrate or sizing agent may optionally contain a bulking agent in any amount, if present, ranging from 0.25 to 50 dry lbs per ton of finished substrate, preferably from 5 to 20, dry lb per ton of finished product when such bulking means is an additive. This range includes 0.25, 0.5, 0.75, 1.0, 2.0, 2.5, 3.0, 3.5, 4, 4.5, 5, 5.5, 6, 6.5, 7, 7.5, 8, 8.5, 9, 9.5, 10, 11, 12, 13, 14, 15, 20, 25, 30, 35, 40, 45, and 50 dry lb per ton of finished product, including any and all ranges and subranges therein.

The bulking agent may be an expandable microsphere, composition, and/or particle for bulking paper articles and substrates. However, any bulking agent can be utilized, while the expandable microsphere, composition, particle and/or paper substrate of that follows is the preferred bulking means. Other alternative bulking agents include, but are not limited to, surfactants, Reactopaque, pre-expanded spheres, BCTMP (bleached chemi-thermomechanical pulp), microfinishing, and multiply construction for creating an I-beam effect in a paper or paper board substrate. Such bulking agents may, when incorporated or applied to a paper substrate, provide adequate print quality, caliper, basis weight, etc in the absence of harsh calendaring conditions (i.e. pressure at a single nip and/or less nips per calendaring means), yet produce a paper substrate having the a single, a portion of, or combination of the physical specifications and performance characteristics mentioned herein.

In one embodiment, the paper substrate may contain from 0.001 to 10 wt %, preferably from 0.02 to 5 wt %, more preferably from 0.025 to 2 wt %, most preferably from 0.125 to 0.5 wt % of expandable microspheres based on the total weight of the substrate.

Examples of expandable microspheres having bulking capacity are those described in U.S. Patent Application No. 60/660,703 filed Mar. 11, 2005, and U.S. patent application Ser. No. 11/374,239 filed Mar. 13, 2006, which are also hereby incorporated, in their entirety, by reference. Further examples include those found in U.S. Pat. No. 6,379,497, filed May 19, 1999, and U.S. Patent Publication No. 2006/0102307, filed Jun. 1, 2004, which are also hereby incorporated, in their entirety, by reference.

Some examples of bulking fibers include, but are not limited to, mechanical fibers such as ground wood pulp, BCTMP, and other mechanical and/or semi-mechanical pulps. When such pulps are added, from 0.25 to 75 wt %, preferably less than 60 wt % of total weight of the fibers used may be from such bulking fibers.

Examples of diamide salts include those described in U.S. Patent Publication No. 2004/0065423, filed Sep. 15, 2003, which is hereby incorporated in its entirety by reference. Non-limiting examples of such salts include mono- and distearamides of animoethylethalonalamine, which may be commercially known as Reactopaque 100, (Omnova Solutions Inc., Performance Chemicals, 1476 J. A. Cochran By-Pass, Chester, S. C. 29706, USA and marketed and sold by Ondeo Nalco Co., with headquarters at Ondeo Nalco Center, Naperville, Ill. 60563, USA) or chemical equivalents thereof. When such salts are used, about 0.025 to about 0.25 wt % by weight dry basis of the diamide salt may be used.

Other optional components include nitrogen containing compounds. Non-limiting examples of these include nitrogen containing organic species, for example oligomers and polymers which contain one or more quaternary ammonium functional groups. Such functional groups may vary widely and include, for example, substituted and unsubstituted amines, imines, amides, urethanes, quaternary ammonium groups, dicyandiamides, guanides, and the like. Illustrative of such materials are polyamines, polyethyleneimines, copolymers of diallyldimethyl ammonium chloride (DADMAC), copolymers of vinyl pyrrolidone (VP) with quaternized diethylaminoethylmethacrylate (DEAMEMA), polyamides, cationic polyurethane latex, cationic polyvinyl alcohol, polyalkylamines dicyandiamid copolymers, amine glycigyl addition polymers, poly[oxyethylene (dimethyliminio) ethylene (dimethyliminio) ethylene]dichlorides, guanidine polymers, and polymeric biguanides. Combinations of these nitrogen containing compounds are possible. Some examples of these compounds are described in, for example, U.S. Pat. No. 4,554,181, U.S. Pat. No. 6,485,139, U.S. Pat. No. 6,686,054, U.S. Pat. No. 6,761,977, and U.S. Pat. No. 6,764,726, the entireties of each of which being hereby incorporated by reference.

The expandable microspheres may contain an expandable shell forming a void inside thereof. The expandable shell may comprise a carbon and/or heteroatom containing compound. An example of a carbon and/or heteroatom containing compound may be an organic polymer and/or copolymer. The polymer and/or copolymer may be branched and/or crosslinked.

Expandable microspheres preferably are heat expandable thermoplastic polymeric hollow spheres containing a thermally activatable expanding agent. Examples of expandable microsphere compositions, their contents, methods of manufacture, and uses can be found, in U.S. Pat. Nos. 3,615,972; 3,864,181; 4,006,273; 4,044,176; and 6,617,364 which are hereby incorporated, in their entirety, herein by reference. Further reference can be made to U.S. Patent Publication Nos. 2001/0044477; 2003/0008931; 2003/0008932; and 2004/0157057, which are hereby incorporated, in their entirety, by reference. Microspheres may be prepared from polyvinylidene chloride, polyacrylonitrile, poly-alkyl methacrylates, polystyrene or vinyl chloride.

Microspheres may contain a polymer and/or copolymer that has a Tg ranging from −150 to +180° C., preferably from 50 to 150° C., most preferably from 75 to 125° C.

Microspheres may also contain at least one blowing agent which, upon application of an amount of heat energy, functions to provide internal pressure on the inside wall of the microsphere in a manner that such pressure causes the sphere to expand. Blowing agents may be liquids and/or gases. Further, examples of blowing agents may be selected from low boiling point molecules and compositions thereof. Such blowing agents may be selected from the lower alkanes such as neopentane, neohexane, hexane, propane, butane, pentane, and mixtures and isomers thereof. Isobutane is the preferred blowing agent for polyvinylidene chloride microspheres. Examples of coated unexpanded and expanded microspheres are disclosed in U.S. Pat. Nos. 4,722,943 and 4,829,094, which are hereby incorporated, in their entirety, by reference.

The expandable microspheres may have a mean diameter ranging from about 0.5 to 200 microns, preferably from 2 to 100 microns, most preferably from 5 to 40 microns in the unexpanded state and having a maximum expansion of from about 1.5 and 10 times, preferably from 2 to 10 times, most preferably from 2 to 5 times the mean diameters.

In one embodiment, the expandable microspheres may be neutral, negatively or positively charged, preferably negatively charged.

One embodiment of the invention relates to a recording sheet for use in printing comprising a substrate formed from cellulosic fibers and having in contact therewith on at least one surface thereof a sizing agent comprising at least one water soluble divalent metal salt, wherein the substrate and sizing agent cooperate to form an I-beam structure. The present inventors have surprisingly discovered that sizing level of the substrate may be suitably reduced if the sizing agent cooperates with the substrate to form an I-beam structure.

The measurement of color gamut may be suitably carried out by known methods.

In one embodiment, the recording sheet desirably exhibits an enhanced image dry time as determined by the amount of ink transferred from a printed to an unprinted portion of the recording sheet after rolling with a roller of fixed weight. The "ink transfer", that is defined as the amount of optical density transferred after rolling with a roller; it is expressed as a percentage of the optical density transferred to the unprinted portion of the recording sheet after rolling with a roller. The method involves printing solid colored blocks on paper, waiting for a fixed amount of time, 5 seconds after printing, and then folding in half so that the printed portion contacts an unprinted portion of the recording sheet, and rolling with a 4.5 lb hand roller as for example roller item number HR-100 from Chem Instruments, Inc., Mentor, Ohio, USA. The optical density is read on the transferred ($OD_T$), the non-transferred ($OD_O$) portions of the block, and an un-imaged area ($OD_B$) by a reflectance densitometer (X-Rite, Macbeth. Etc.). The percent transferred ("IT %") is defined as IT %=$[(OD_T-OD_B)/(OD_O-OD_B)]\times100$.

Given the teachings herein, the Hercules Sizing Test Value ("HST") of the substrate and the amount and/or type of water soluble divalent salt may be suitably selected such that the recording sheet has a percent ink transferred ("IT %") equal to or less than about 60. Preferably, the IT % is from 0% to about 50%. More preferably, the IT % is from 0% to about 40%. Most preferably, the IT % is from 0% to about 30%.

In addition to improved image dry time, the recording sheets exhibit good print quality. As used herein, print quality (PQ) is measured by two important parameters: print density and edge acuity. Print density is measured using a reflectance densitometer (X-Rite, Macbeth. Etc.) in units of optical density ("OD"). The method involves printing a solid block of color on the sheet, and measuring the optical density. There is some variation in OD depending on the particular printer used and the print mode chosen, as well as the densitometer mode and color setting. The printer is not particularly limited and may be, for example, an HP Deskjet 6122, manufactured by Hewlett-Packard, which uses a #45 (HP product number 51645A) black ink jet cartridge. The print mode is determined by the type of paper and the print quality selected. The default setting of Plain Paper type and Fast Normal print quality print mode may be suitably selected. A suitable densitometer may be an X-Rite model 528 spectrodensitometer with a 6 mm aperture. The density measurement settings may suitably be Visual color, status T, and absolute density mode. An increase in print density may typically be seen when sufficient amounts of divalent water soluble metal salts are on the paper surface. In general, the target optical density for pigment black ("$OD_O$") is equal to or greater than 1.10 in the standard (plain paper, normal) print mode for the HP desktop ink jet printers that use the most common black pigment ink (equivalent to the #45 ink jet cartridge). Preferably, the $OD_O$ is equal to or greater than about 1.15. More preferably, the $OD_O$ is equal to or greater than about 1.20. Most preferably, the OD is equal to or greater than about 1.50 or even 1.60. The $OD_O$ may be equal to or greater than 1.1, 1.15, 1.2, 1.25, 1.3, 1.35, 1.4, 1.45, 1.5, 1.55, and even equal to or greater than 1.6, including any and all ranges and subranges therein.

The recording sheets exhibit good edge acuity ("EA"). Edge acuity is measured by an instrument such as the QEA Personal Image Analysis System (Quality Engineering Associates, Burlington, Mass.), the QEA ScannerIAS, or the ImageXpert KDY camera-based system. All of these instruments collect a magnified digital image of the sample and calculate an edge acuity value by image analysis. This value is also called edge raggedness, and is defined in ISO method 13660. The method involves printing a solid line 1.27 millimeters or more in length, sampling at a resolution of at least 600 dpi. The instrument calculates the location of the edge based on the darkness of each pixel near the line edges. The edge threshold is defined as the point of 60% transition from the substrate reflectance factor (light area, $R_{max}$) to the image reflectance factor (dark area, $R_{max}$) using the equation $R_{60}=R_{max}-60\%\ (R_{max}-R_{min})$. The edge raggedness is then defined as the standard deviation of the residuals from a line fitted to the edge threshold of the line, calculated perpendicular to the fitted line. The value of edge acuity is preferably less than about 15. Preferably, the EA is less than about 12. More preferably, the EA is less than about 10. Most preferably, the EA is less than about 8.

The recording sheet preferably has high dimensional stability. Recording sheets having high dimensional stability preferably have a diminished tendency to curling. Therefore, preferable recording sheets of the present invention have reduced tendency to curl as compared to conventional recording sheets.

One useful indicator of dimensional stability is the physical measurement of hygroexpansivity, such as Neenah hygroexpansion using TAPPI USEFUL METHOD 549 by electronic monitoring and control of Relative Humidity (RH) using a desiccator and humidifier rather than simply salt concentration. The RH of the surrounding environment is changed from 50% to 15% then to 85%, causing dimensional changes in the paper sample that are measured. For example, the recording sheet of the present invention may have a hygroexpansivity in the CD direction when changing the RH as indicated above of from 0.1 to 1.9%, preferably from 0.7 to 1.2%, most preferably from 0.8 to 1.0%. This range includes 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, and 1.9%, including any and all ranges and subranges therein.

The recording sheet preferably has a MD internal bond of from 10 to 350 ft-lbs$\times10^{-3}$/in$^2$, preferably from 75 to 120 ft-lbs$\times10^{-3}$/in$^2$, more preferably from 80 to 100 ft-lbs$\times10^{-3}$/in 2, most preferably from to 90 to 100 ft-lbs$\times10^{-3}$/in$^2$. This range includes 10, 11, 12, 13, 14, 15, 20, 25, 30, 35, 40, 45, 50, 55, 60, 65, 70, 75, 80, 85, 90, 95, 100, 105, 110, 115, 120, 125, 130, 135, 140, 145, 150, 160, 165, 170, 175, 180, 185, 190, 195, 200, 210, 220, 230, 240, 250, 260, 270, 280, 290, 300, 310, 320, 330, 340, and 350 ft-lbs$\times10^{-3}$/in$^2$, including any and all ranges and subranges therein. The MD internal bond is Scott Bond as measured by test TAPPI t-569.

The recording sheet preferably has a CD internal bond of from 10 to 350 ft-lbs$\times10^{-3}$/in$^2$, preferably from 75 to 120 ft-lbs$\times10^{-3}$/in$^2$, more preferably from 80 to 100 ft-lbs$\times10^{-3}$/in 2, most preferably from to 90 to 100 ft-lbs$\times10^{-3}$/in$^2$. This range includes 10, 11, 12, 13, 14, 15, 20, 25, 30, 35, 40, 45, 50, 55, 60, 65, 70, 75, 80, 85, 90, 95, 100, 105, 110, 115, 120, 125, 130, 135, 140, 145, 150, 160, 165, 170, 175, 180, 185, 190, 195, 200, 210, 220, 230, 240, 250, 260, 270, 280, 290, 300, 310, 320, 330, 340, and 350 ft-lbs$\times10^{-3}$/in$^2$, including any and all ranges and subranges therein. The CD internal bond is Scott Bond as measured by test TAPPI t-569.

Both of the above-mentioned CD and MD internal bond as measured by Scott Bond test TAPPI t-569 may also be measured in J/m$^2$. The conversion factor to convert ft-lbs$\times10^{-3}$/in$^2$ to J/m$^2$ is 2. Therefore, to convert an internal bond of 100 ft-lbs$\times10^{-3}$/in$^2$ to J/m$^2$, simply multiply by 2 (i.e. 100 ft-lbs$\times10^{-3}$/in$^2\times2$ J/m$^2$/1 ft-lbs$\times10^{-3}$/in$^2$=200 J/m$^2$. All of the above-mentioned ranges in ft-lbs$\times10^{-3}$/in$^2$, therefore, may then include the corresponding ranges for internal bonds in J/m$^2$ as follows.

The recording sheet preferably has a MD internal bond of from 20 to 700 J/m$^2$, preferably from 150 to 240 J/m$^2$, more preferably from 160 to 200 J/m$^2$, most preferably from 180 to 200 J/m$^2$. This range includes 20, 22, 24, 26, 28, 30, 40, 50, 60, 70, 80, 90, 100, 110, 120, 130, 140, 150, 160, 170, 180, 190, 200, 210, 220, 230, 240, 250, 260, 270, 280, 290, 300, 320, 330, 340, 350, 360, 370, 380, 390, 400, 420, 440, 460, 480, 500, 520, 540, 560, 580, 600, 620, 640, 660, 680, and 700 J/m$^2$, including any and all ranges and subranges therein. The MD internal bond is Scott Bond as measured by test TAPPI t-569.

The recording sheet preferably has a CD internal bond of from 20 to 700 J/m$^2$, preferably from 150 to 240 J/m$^2$, more preferably from 160 to 200 J/m$^2$, most preferably from 180 to 200 J/m$^2$. This range includes 20, 22, 24, 26, 28, 30, 40, 50, 60, 70, 80, 90, 100, 110, 120, 130, 140, 150, 160, 170, 180, 190, 200, 210, 220, 230, 240, 250, 260, 270, 280, 290, 300, 320, 330, 340, 350, 360, 370, 380, 390, 400, 420, 440, 460, 480, 500, 520, 540, 560, 580, 600, 620, 640, 660, 680, and 700 J/m$^2$, including any and all ranges and subranges therein. The CD internal bond is Scott Bond as measured by test TAPPI t-569.

The recording sheet may have any Internal Bond/sizing agent load ratio. In one embodiment, the substrate contains high amounts of sizing agent and/or sizing agent load, while at the same time has low Internal Bond. Accordingly, in one embodiment, the Internal Bond/sizing agent load ratio may approach 0. In another embodiment, the recording sheet that has an Internal Bond that either decreases, or remains constant, or increases minimally with increasing sizing content and/or sizing loading. In another embodiment, the change in Internal Bond of the recording sheet is 0, negative, or a small positive number as the sizing agent load increases. It is desirable to have the recording sheet exhibit such a phenomenon at various degrees of sizing agent wt % solids that are applied to the fibers via a size press as discussed above. In an additional embodiment, it is desirable to have the recording sheet to possess any one of and/or all of the above-mentioned phenomena and also have a strong surface strength as measured by IGT pick and/or wax pick tests discussed above. The recording sheet may have any Internal Bond/sizing agent load ratio. The Internal Bond/sizing agent load ratio may be less than 100, preferably less than 80, more preferably less than 60, most preferably less than 40 J/m$^2$/gsm. The Internal Bond/sizing agent load ratio may be less than 100, 95, 90, 85, 80, 75, 74, 73, 72, 71, 70, 69, 68, 67, 66, 65, 64, 63, 62, 61, 60, 59, 58, 57, 56, 55, 54, 53, 52, 51, 50, 49, 48, 47, 46, 45, 44, 43, 42, 41, 40, 38, 35, 32, 30, 28, 25, 22, 20, 18, 15, 12, 10, 7, 5, 4, 3, 2, and 1 J/m$^2$/gsm, including any and all ranges and subranges therein.

The paper substate preferably has a Gurley porosity of from about 5 to 100 sec/100 ml. This range includes 5, 10, 11, 12, 13, 14, 15, 20, 25, 30, 35, 40, 45, 50, 55, 60, 70, 75, 80, 90, 95 and 100 sec/100 ml, including any and all ranges and subranges therein. The Gurley porosity is measured by test TAPPI t-460 om-88.

The paper substate preferably has a CD Gurley Stiffness of from 100 to 450 mgf, preferably 150 to 450 mgf, more preferably from 200 to 350 mgf This range includes 100, 110, 120, 130, 140, 150, 160, 170, 180, 190, 200, 210, 220, 230, 240, 250, 260, 270, 280, 290, 300, 310, 320, 330, 340, 350, 375, 400, 425, and 450 mgf, including any and all ranges and subranges therein. The CD Gurley Stiffness is measured by test TAPPI t-543.

The paper substate preferably has a MD Gurley Stiffness of from 40 to 250 mgf, more preferably from 100 to 150 mgf. This range includes 40, 50, 60, 70, 80, 90, 100, 110, 120, 130, 140, 150, 160, 170, 180, 190, 200, 210, 220, 230, 240, and 250 mgf, including any and all ranges and subranges therein. The MD Gurley Stiffness is measured by test TAPPI t-543.

The paper substate preferably has an opacity of from 85 to 105%, more preferably from 90 to 97%. This range includes 85, 86, 87, 88, 89, 90, 91, 92, 93, 94, 95, 96, 97, 98, 99, 100, 101, 102, 103, 104, and 105%, including any and all ranges and subranges therein. The opacity is measured by test TAPPI t-425.

The recording sheet of the present invention may have any CIE whiteness, but preferably has a CIE whiteness of greater than 70, more preferably greater than 100, most preferably greater than 125 or even greater than 150. The CIE whiteness may be in the range of from 125 to 200, preferably from 130 to 200, most preferably from 150 to 200. The CIE whiteness range may be greater than or equal to 70, 80, 90, 100, 110, 120, 125, 130, 135, 140, 145, 150, 155, 160, 65, 170, 175, 180, 185, 190, 195, and 200 CIE whiteness points, including any and all ranges and subranges therein. Examples of measuring CIE whiteness and obtaining such whiteness in a papermaking fiber and paper made therefrom can be found, for example, in U.S. Pat. No. 6,893,473, which is hereby incorporated, in its entirety, herein by reference. Further, examples of measuring CIE whiteness and obtaining such whiteness in a papermaking fiber and paper made therefrom can be found, for example, in U.S. Patent Application No. 60/654,712 filed Feb. 19, 2005, and U.S. patent application Ser. Nos. 11/358,543 filed Feb. 21, 2006; 11/445,809 filed Jun. 2, 2006; and 11/446,421 filed Jun. 2, 2006, which are also hereby incorporated, in their entirety, herein by reference.

The recording sheet of the present invention may have any ISO brightness, but preferably greater than 80, more preferably greater than 90, most preferably greater than 95 ISO brightness points. The ISO brightness may be preferably from 80 to 100, more preferably from 90 to 100, most preferably from 95 to 100 ISO brightness points. This range include greater than or equal to 80, 85, 90, 91, 92, 93, 94, 95, 96, 97, 98, 99, and 100 ISO brightness points, including any and all ranges and subranges therein. Examples of measuring ISO brightness and obtaining such brightness in a papermaking fiber and paper made therefrom can be found, for example, in U.S. Pat. No. 6,893,473, which is hereby incorporated, in its entirety, herein by reference. Further, examples of measuring ISO brightness and obtaining such brightness in a papermaking fiber and paper made therefrom can be found, for example, in U.S. Patent Application Nos. 60/654,712 filed Feb. 19, 2005, and U.S. patent application Ser. Nos. 11/358,543 filed Feb. 21, 2006, which are also hereby incorporated, in their entirety, herein by reference.

The recording sheet has an improved print performance and improved runnability (e.g. print press performance). Print performance may be measured by determining improved ink density, dot gain, trapping, print contrast, and/or print hue, to name a few. Colors traditionally used in such performance tests include black, cyan, magenta and yellow, but are by no means limited thereto. Press performance may be determined by print contamination determinations through visual inspection of press systems, blankets, plates, ink system, etc. Contamination usually includes fiber contamination, coating or sizing contamination, filler or binder contamination, piling, etc. The recording sheet of the present invention has an improved print performance and/or runnability as determined by each or any one or combination of the above attributes.

The recording sheet may have any surface strength. Examples of physical tests of a substrate's surface strength that also seem to correlate well with a substrate's print performance are the IGT pick tests and wax pick tests. Further, both tests are known in the art to correlate well with strong surface strength of recording sheets. While either of these tests may be utilized, IGT pick tests are preferred. IGT pick test is a standard test in which performance is measured by Tappi Test Method 575, which corresponds to the standard test ISO 3873.

The recording sheet may have at least one surface having a surface strength as measured by IGT pick test that is at least about 1, preferably at least about 1.2, more preferably at least about 1.4, most preferable at least about 1.8 m/s. The substrate has a surface strength as measured by IGT pick test that is at least about 2.5, 2.4, 2.3, 2.2, 2.1, 2.0, 1.9, 1.8, 1.7, 1.6, 1.5, 1.4, 1.3, 1.2, 1.1, and 1.0 m/s, including any and all ranges and subranges therein.

Another known related test is one that which measures IGT VPP delamination and is commonly known in the art (measured in N/m). The IGT VPP delamination of the recording sheet of the present invention may be any, but is preferably greater than 150 N/m, more preferably greater than 190 N/m, most preferably greater than 210 N/m. If the substrate is a repro-paper substrate, then the IGT VPP delamination is preferably from 150 to 175 N/m, including any and all ranges and subranges therein.

The paper substrate may have any basis weight. It may have either a high or low basis weight, including basis weights of at least 10 lbs/3000 square foot, preferably from at least 20 to 500 lbs/3000 square foot, more preferably from at least 40 to 325 lbs/3000 square foot. The basis weight may be at least 10, 20, 30, 40, 50, 60, 70, 80, 90, 100, 125, 150, 175, 200, 225, 250, 275, 300, 325, 350, 375, 400, 425, 450, 475, and 500 lbs/3000 square feet, including any and all ranges and subranges therein.

The paper substrate according to the present invention may have any apparent density. The apparent density may range from 1 to 20, preferably 4 to 14, most preferably from 5 to 10 lb/3000 sq. ft per 0.001 inch thickness. The density may be at least 1, 2, 3, 4, 5, 6, 7, 8, 9, 10, 11, 12, 13, 14, 15, 16, 17, 18, 19, and 20 lb/3000 sq. ft per 0.001 inch thickness, including any and all ranges and subranges therein.

The paper substrate according to the present invention may have any caliper. The caliper may be from 2 to 35 mil, preferably from 5 to 30 mil, more preferably from 10 to 28 mil, most preferably from 12 to 24 mil. The caliper may be at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, and 35 mil, including any and all ranges and subranges therein.

The recording sheet may be suitably printed by generating images on a surface of the recording sheet using conventional printing processes and apparatus as for example laser, ink jet, offset and flexo printing processes and apparatus. In this method, the recording sheet of this invention is incorporated into a printing apparatus; and an image is formed on a surface of the sheet. The recording sheet of this invention may be printed with ink jet printing processes and apparatus such as, for example, desk top ink jet printing and high speed commercial ink jet printing. In one embodiment, an ink jet printing process is contemplated wherein an aqueous recording liquid is applied to a recording sheet of the present invention in an image wise pattern. In another embodiment, an ink jet printing process is contemplated which includes (1) incorporating into an inkjet printing apparatus containing an aqueous ink a recording sheet of the present invention, and (2) causing droplets of the ink to be ejected in an image wise pattern onto the recording sheet, thereby generating images on the recording sheet. Ink jet printing processes are well known, and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530. In one embodiment, the ink jet printing apparatus employs a thermal ink jet process wherein the ink in the nozzles is selectively heated in an imagewise pattern, thereby causing droplets of the ink to be ejected onto the recording sheet in imagewise pattern. The recording sheets of the present invention can also be used in any other printing or imaging process, such as printing with pen plotters, imaging with color laser printers or copiers, handwriting with ink pens, offset printing processes, or the like, provided that the toner or ink employed to form the image is compatible with the ink receiving layer of the recording sheet. The determination of such compatibility is easily carried out given the teachings herein combined with the ordinary skill of one knowledgeable in the printing art.

The relevant contents of each of U.S. Provisional Patent Application 60/759,629, filed Jan. 17, 2006; U.S. Provisional Patent Application 60/853,882, filed Oct. 24, 2006; U.S. Provisional Patent Application 60/759,630, filed Jan. 17, 2006; U.S. patent application Ser. No. 10/662,699, filed Sep. 15, 2003, and published Apr. 8, 2004, as U.S. Patent Application Publication No. 2004/0065423; U.S. patent application Ser. No. 11/655,004, filed Jan. 17, 2007, and published Feb. 14, 2008, as U.S. Patent Application Publication 2008/0035292 are independently incorporated herein by reference.

The entire contents of "Handbook for Pulp and Paper Technologists" by G. A. Smook (1992) Angus Wilde Publications, is incorporated herein by reference.

All of the references, as well as their cited references, cited herein are hereby incorporated by reference with respect to relative portions related to the subject matter of the present invention and all of its embodiments

EXAMPLES

The present invention may be described in further detail with reference to the following examples. The examples are intended to be illustrative, but the invention is not considered as being limited to the materials, conditions, or process parameters set forth in the examples. All parts and percentages are by unit weight unless otherwise indicated.

PROCESS CONDITIONS AND COATERS: The process conditions and coaters are described below and further in Table 1. Recording sheets were prepared in paper machines or small size presses: the DT coater and Puddle size press. Both the DT coater and the Puddle size press are small pilot scale coating machines, capable of coating a roll of paper (rather than individual sheets) up to about 12 inches wide and at about 100 ft/min. The DT coater is a DT Laboratory Coater, manufactured by DT Paper Science of Finland and available in the U.S. through Kaltec Scientific of Novi, Mich. Coating is carried out for about 1-2 minutes once the coater is up to speed and the coating process stable. The DT coater can be run in either a rod-metered or blade-metered size press mode. These modes coat only one side of the sheet at a time. For present purposes, the DT coater is usually run in rod-metered mode. Several rods of different size may be used to change the wet film thickness that is deposited on the application roller, and then onto the sheet. The dry pickup (dry lbs/ton of paper) may be suitably controlled with rod choice and the % solids. The paper is then dried by an infrared dryer, and then by a forced air oven (both are non-contact drying). The DT coater coats one side at a time, the other side has to be coated either before or after the first side. For present purposes, the paper was generally coated on the first side, and the I-Beam structure on that side was checked and verified (amount of penetration of the coating into the sheet) before coating the second side. The second side was then coated with a simple formulation (starch only). The back side was coated using the same conditions as the front side to maintain I-Beam structure conditions on both sides of the paper. It was necessary to coat both sides of the paper with a similar pickup to minimize curl of the final sheet for ease of printing and minimal jamming.

The Puddle size press coats both sides of the paper at the same time. The paper is saturated with coating fluid before going through the nip between two rollers, which limits pickup. The nip pressure is set to obtain about 25-35% wet pickup, measured as a percentage of the dry weight of the sheet. As such, if the dry paper weighs 1 gram before going through the puddle and nip, it will weigh 1.25 to 1.35 gram after being wetted. The paper is then dried by four steam cans (contact drying, such as found on most paper machines).

Both paper machines have rod-metered size presses, which coat both sides of the paper at the same time. The paper is then dried by a series of steam cans (hot stainless steel rollers filled with pressurized steam).

TABLE 1

Process Conditions and Size Formulations

| Condition | A | B | C | D | E | F | G |
|---|---|---|---|---|---|---|---|
| Coater Name | DT Coater | Puddle size press | DT Coater | Puddle size press | DT Coater | Paper Machine #1 | Paper Machine #2 |
| Coater Type | Pilot scale rod metered size press | Pilot scale puddle size press | Pilot scale rod metered size press | Pilot scale puddle size press | Pilot scale rod metered size press | Paper mill rod metered size press | Paper mill rod metered size press |
| Sides Coated/Pass | 1 | 2 | 1 | 2 | 1 | 2 | 2 |
| Structure | I-Beam | No I-Beam | No I-Beam | No I-Beam | I-Beam | I-Beam | No I-Beam |
| % Solids | 15-19 | 14.5-17.5 | 14.5-17.5 | 14.5-17.5 | 23-28 | 19 | 11 |
| Temperature ° F. | 125-140 | 150-170 | 150-170 | 150-170 | 125-140 | 150 | 150 |
| viscosity, cP | (not measured) | (not measured) | (not measured) | (not measured) | 230-500 | 40-60 | 20-30 |
| Dry pickup of Sizing Agent, gsm | 2.6-4.6 | 2.4-3.8 | 2.6-3.0 | 2.4-3.8 | 2.5-4.6 | 4-5 | 3-4 |
| Wet film thickness, microns | 19 | N/A (puddle) | 19 | N/A (puddle) | 19 | to give proper pickup | to give proper pickup |
| Sizing formulations | Starch + $CaCl_2$<br>Starch + GCC + $CaCl_2$ | Starch + $CaCl_2$<br>Starch + GCC + $CaCl_2$ | Starch + $CaCl_2$<br>Starch + GCC + $CaCl_2$ | Starch + $CaCl_2$<br>Starch + GCC + $CaCl_2$ | Starch + $CaCl_2$<br>Starch + GCC + $CaCl_2$ | Starch + $CaCl_2$<br>Starch + GCC + $CaCl_2$ | Starch + $CaCl_2$<br>Starch + GCC + $CaCl_2$ |
| Paper | 20# basis weight base | 20# basis weight base | 20# basis weight base | 20# basis weight base | 20# basis weight base | 20# basis weight base | 20# basis weight base |

GCC is $CaCO_3$ pigment; sizings were run at various $CaCl_2$ loadings (ave 0, 3, 5, 7, 8, 10, 15, 20 lbs/ton $CaCl_2$)
1 mol $CaCl_2$ = 0.2447 lbs $CaCl_2$ In Table 1 above, conditions A, E and F, and the resulting recording sheets are in accordance with embodiments of the invention; conditions B. D and G, and resulting recording sheets are provided for comparison.

Example 1

Evaluation of I-Beam Structure (FIG. 1): Two differently prepared samples, A and B, were subjected to starch penetration. The A sample did not have an I-beam structure; the B sample had an I-beam structure. The thus-prepared samples were tested for starch penetration in the z direction by optical microscopy to determine if either sample displayed the I-beam structure.

Starch penetration was performed and measured by cross-sectioning the sample using a razor blade, staining with iodine solution and imaging after approximately 5 minutes. A total of four iterations per sample were performed. One image, which best represented the overall starch penetration characteristics, is shown for each sample. Sample A was fully penetrated with starch (FIG. 1). Sample B displayed an I-beam structure as evidenced by starch on either side of the sheet and a starch free region in the center (FIG. 1). The unusual color reaction of the B sample can be attributed to the use of Clinton 442 Oxidized starch.

Example 2

Two sizing formulations were prepared and recording sheets prepared in the DT coater according to Condition A in Table 1:

Starch+$CaCl_2$ (Sample 7) and Starch+GCC+$CaCl_2$ (Sample 8)

Four Salt Levels: 0, 3, 5, 8 lbs/ton

20# basis weight Base Paper

Nip Pressure: 3 psi (Sample 7) and 6 psi (Sample 8)

Figure 2:
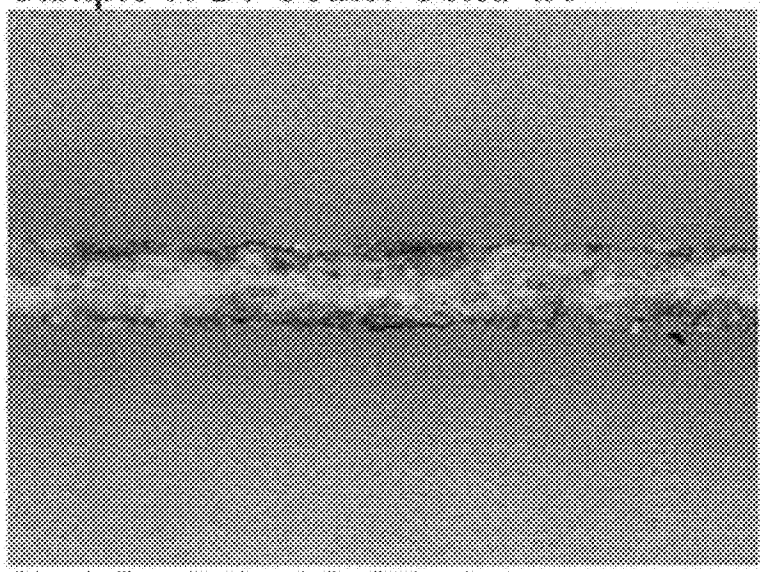
FIG. 2 shows an optical microscope evaluation of starch penetration in I-Beam structure for exemplary embodiments in the examples.
Figure 2:
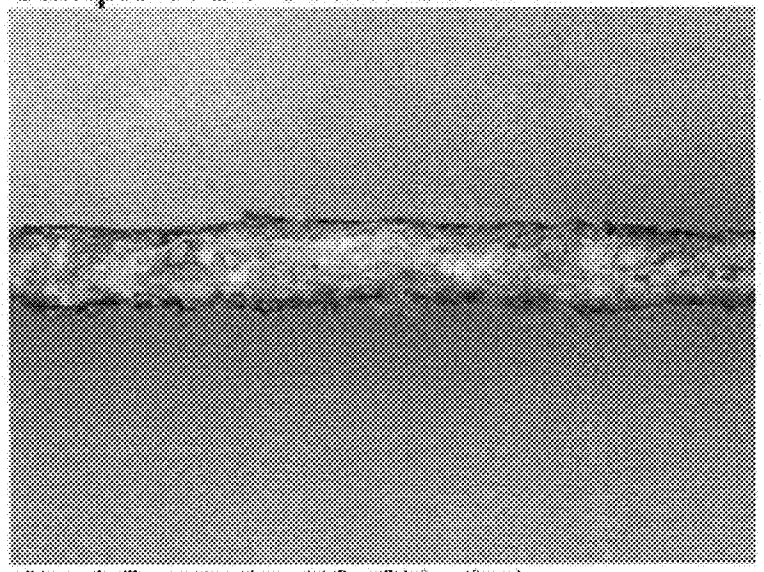
Figure 3:
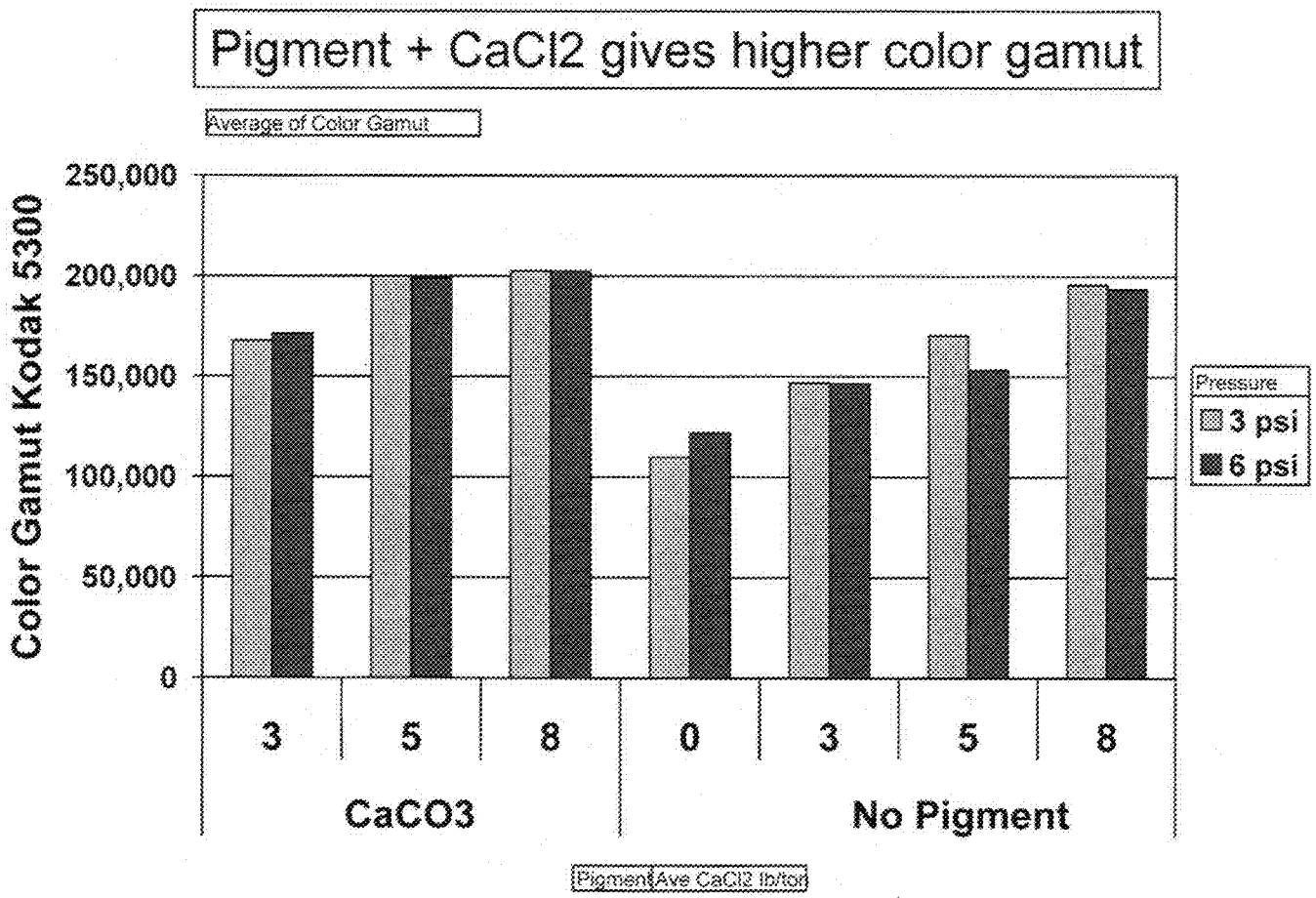
FIG. 3 is a graph showing color gamut results for exemplary pigmented and non-pigmented embodiments at different nip pressures, pigment loadings, and divalent metal salt loadings.

Optical microscopy of iodine-stained samples in cross-section showed that both nip pressures gave I-Beam structures (FIG. 2). Both nip pressures of 3 and 6 psi, respectively, gave similar print results (FIG. 3). The combination of $CaCO_3$ pigment and $CaCl_2$ exhibited a higher average color gamut (FIG. 3).

Example 3

Figure 4:
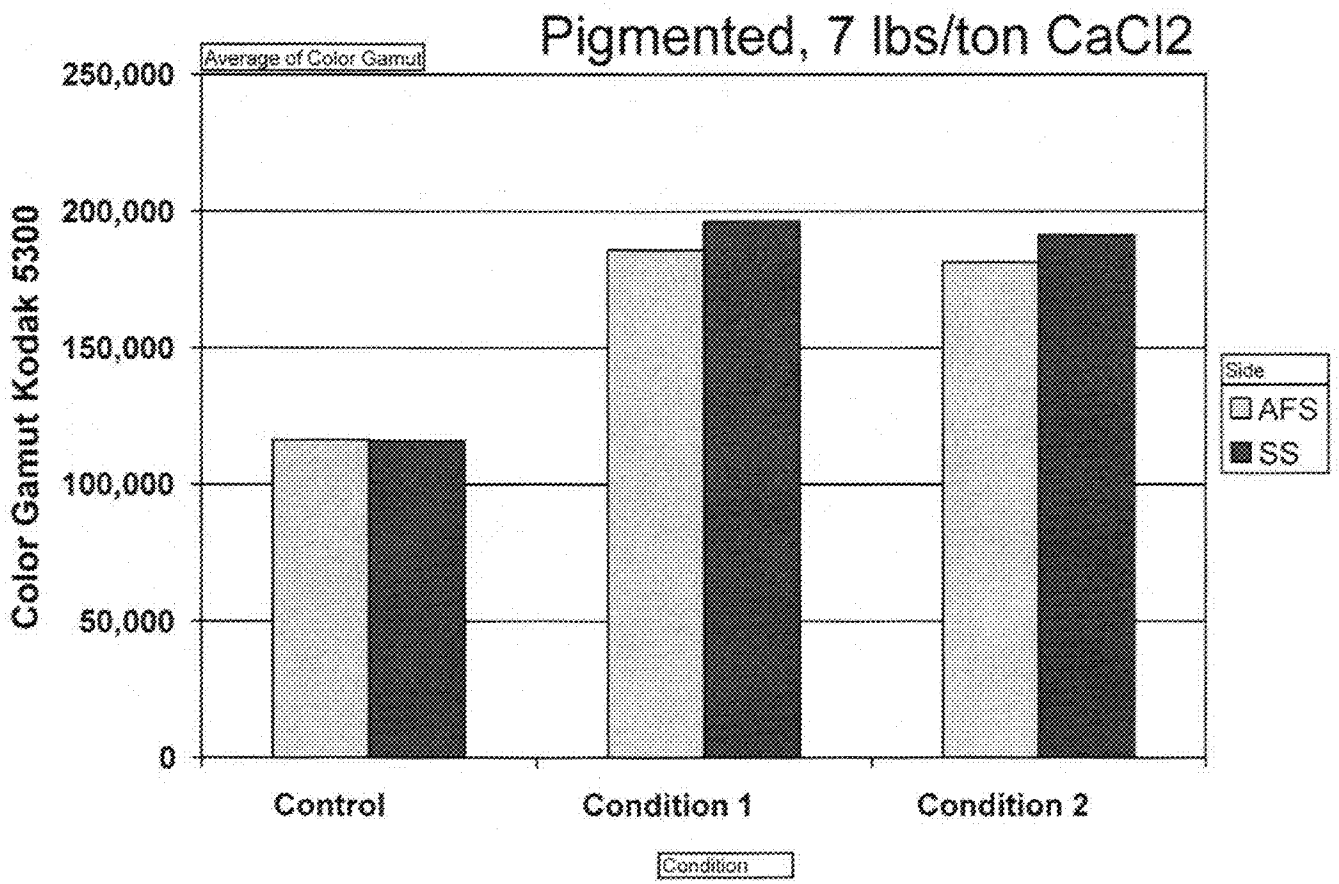
FIG. 4 is a graph showing color gamut results for exemplary and comparative embodiments in the examples.

Recording sheets were prepared according to Condition F in Table 1 on 8.5"×11" paper. The control did not contain $CaCl_2$. Conditions 1 and 2 contained 7 lbs/ton $CaCl_2$ (FIG. 4). The front side (AFS) and seamside/backside (SS) were printed and evaluated for average color gamut. A higher color gamut was observed for the Condition 1 and 2 samples.

Example 4

Comparative Example

Recording sheets were prepared according to Condition B in Table 1:

Starch+$CaCl_2$

Starch+GCC+$CaCl_2$

Four Salt Levels: 0, 3, 5, 8 lbs/ton

20# basis weight Base Paper.

Figure 5:
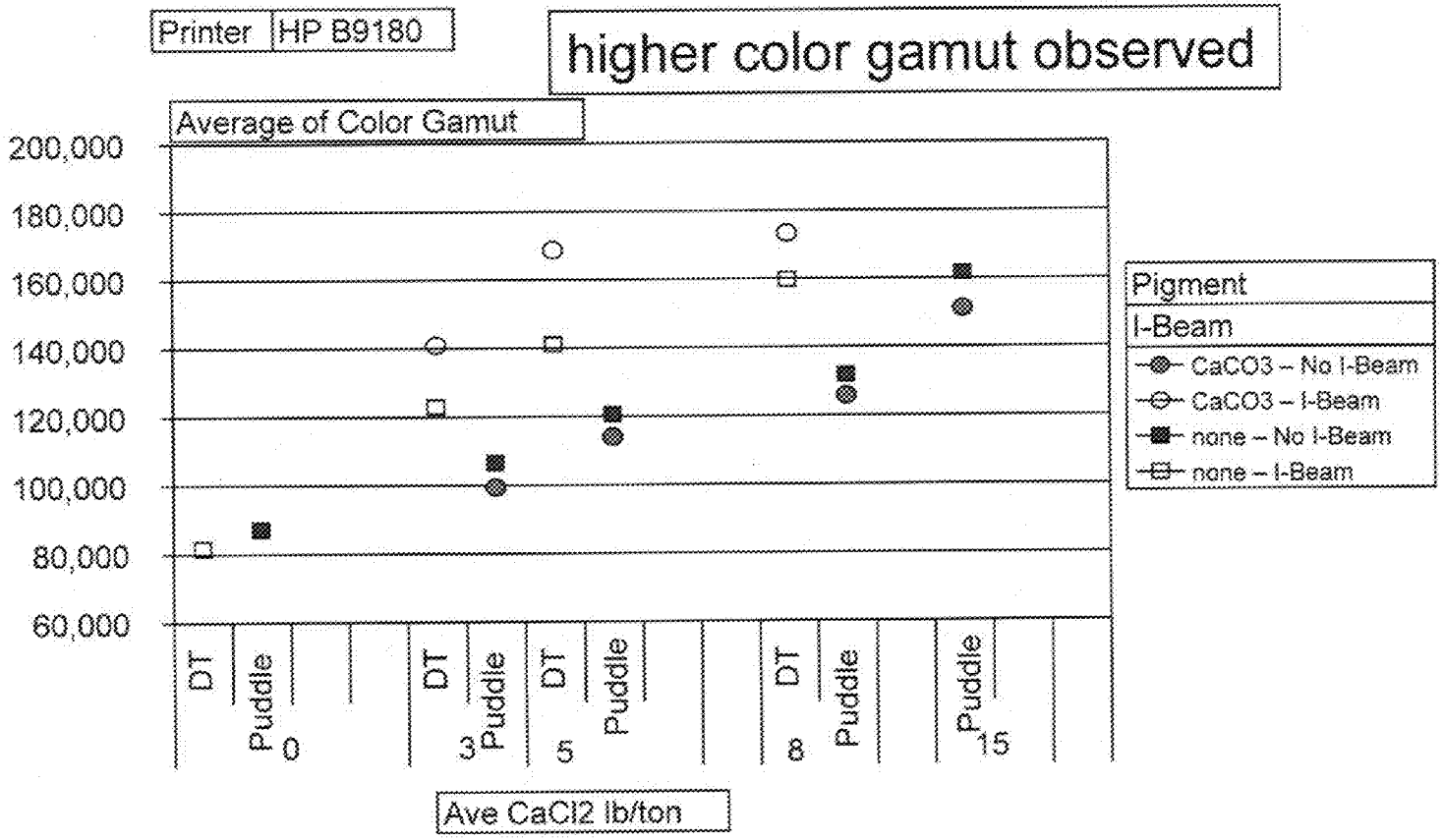
FIG. 5 is a graph showing the average of color gamut on the y-axis for comparative and exemplary embodiments in the examples.

An HP B9180 printer was used to print images for evaluation. The comparative example and results obtained from the Puddle size press are shown in FIG. 5 (the average color gamut from Example 2 using the DT coater are also shown in FIG. 5). Overall, a higher color gamut was observed for the exemplary recording sheets prepared according to Condition A in Table 1. A lower average color gamut was observed for the comparative recording sheets prepared according to Condition B in Table 1.

Example 5

Figure 6:
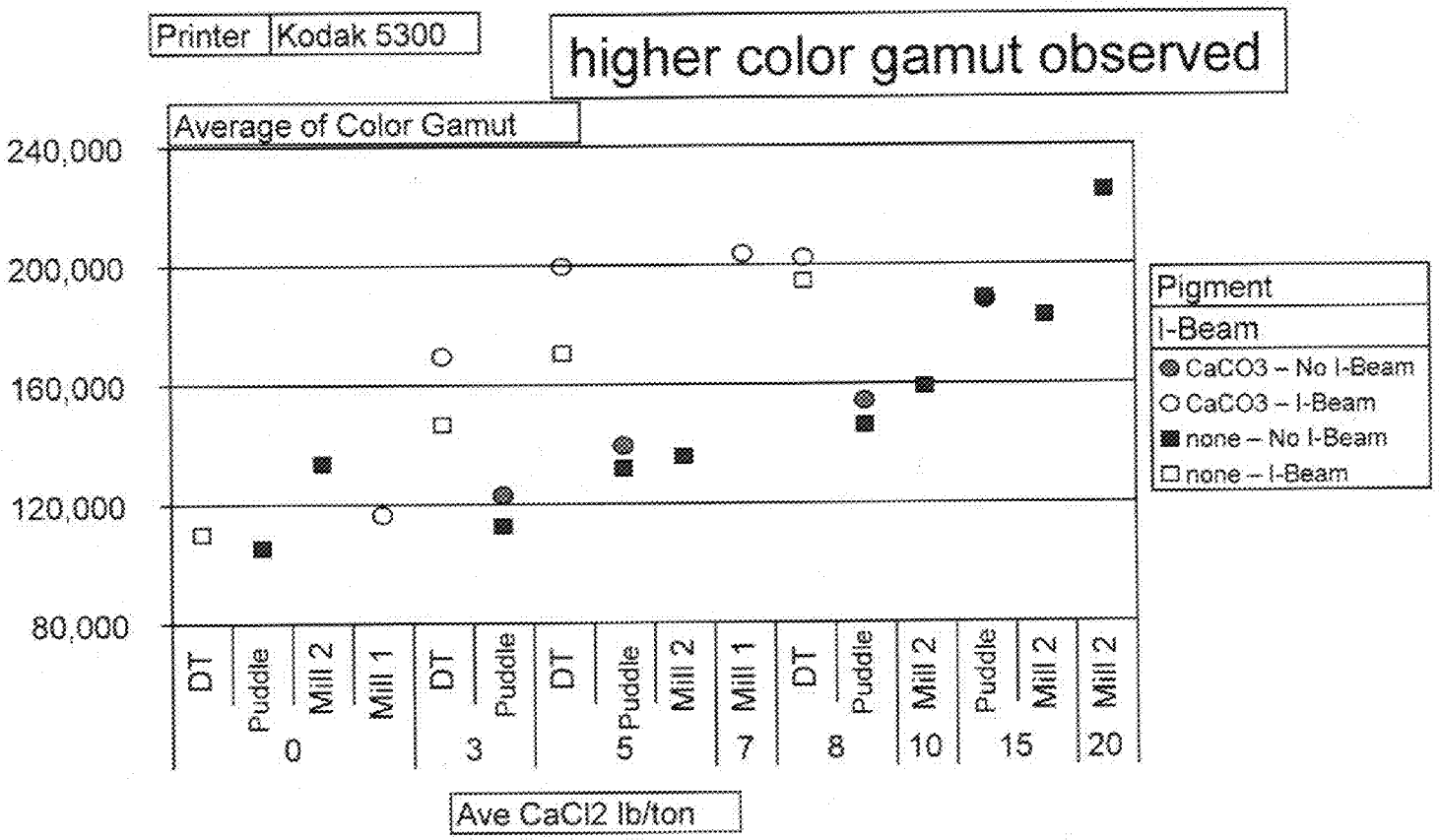
FIG. 6 is a graph showing the average of color gamut on the y-axis for comparative and exemplary embodiments in the examples.

Recording sheets were prepared using Condition G in Table 1 and printed with a Kodak 5300 printer. Color gamut was evaluated and the results are shown in FIG. 6. Recording sheets prepared according to Conditions A, B and F in Table 1 were also evaluated, and the results for these sheets are also shown in FIG. 6. A higher color gamut was observed for the exemplary recording sheets prepared according to Conditions A and F relative to the comparative recording sheets prepared according to Conditions B and G.

Example 6

Figure 7:
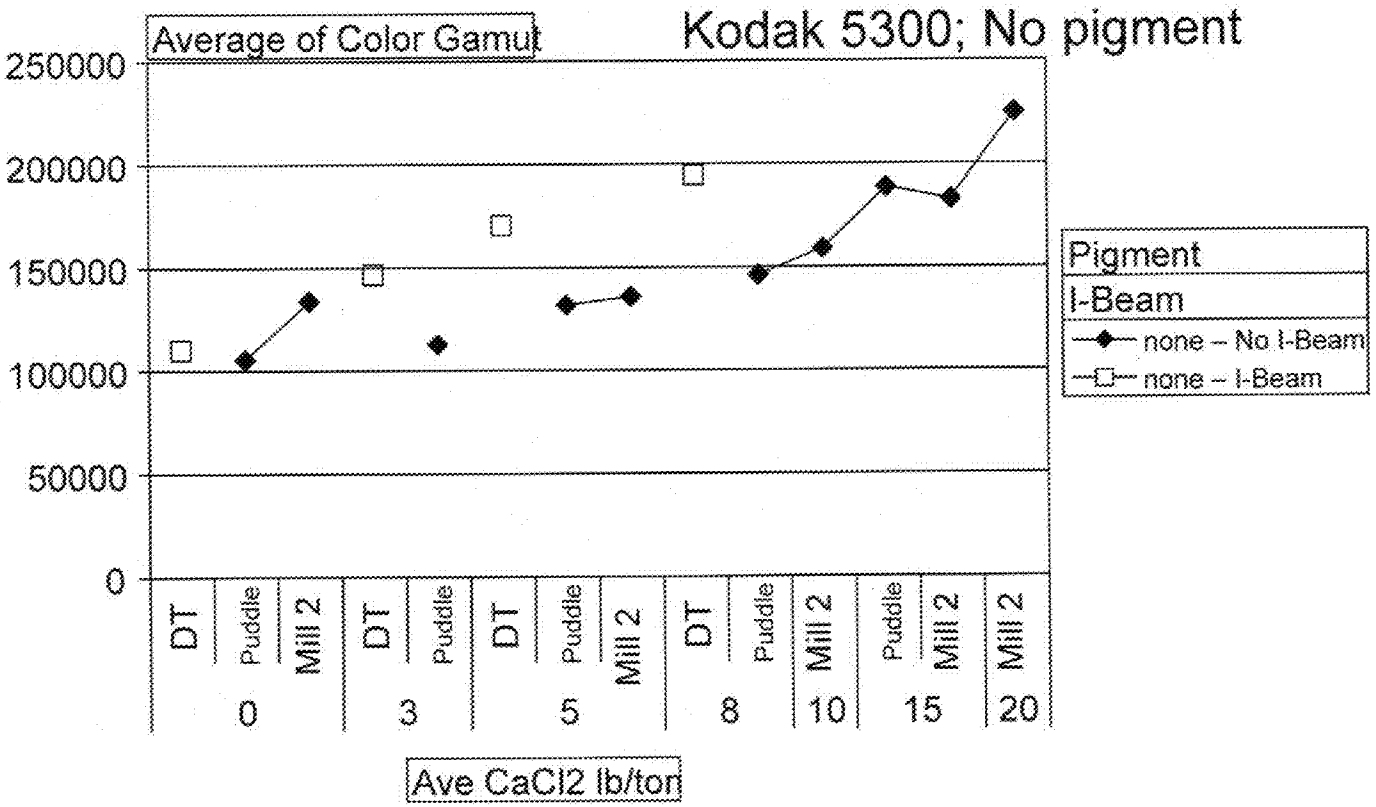
FIG. 7 is a graph showing the average of color gamut on the y-axis for comparative and exemplary non-pigmented embodiments in the examples.

FIG. 7 shows the average of color gamut for the non-pigment-containing samples prepared according to Conditions A, B, and G in Table 1. Even in the absence of pigment, the exemplary recording sheets prepared according to Condition A exhibit a higher average color gamut, when compared to the comparative recording sheets prepared according to Conditions B and G.

Example 7

Figure 8:
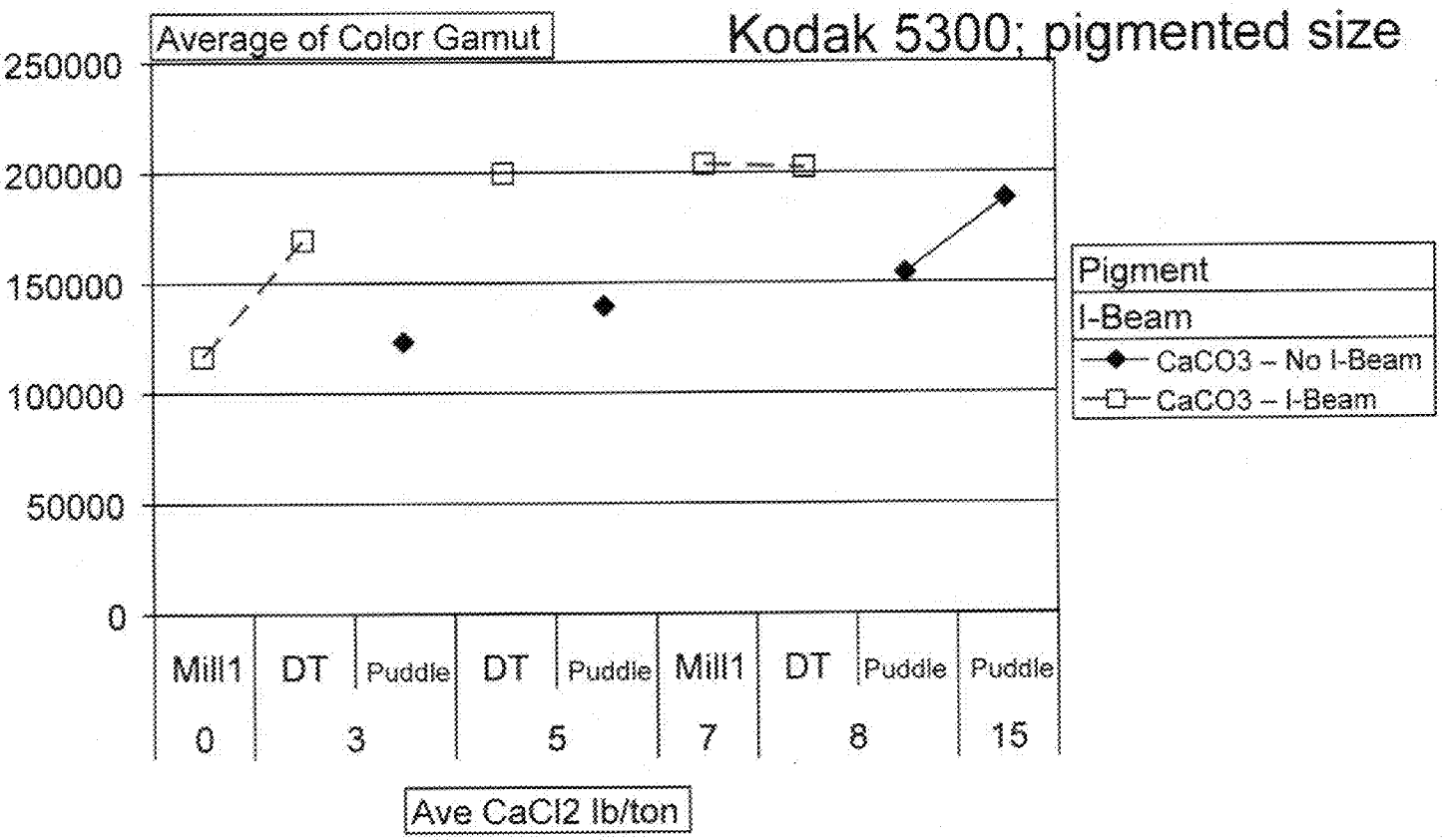
FIG. 8 is a graph showing the average of color gamut on the y-axis for comparative and exemplary pigment-containing embodiments in the examples.

FIG. 8 shows the average of color gamut for the pigment-containing recording sheets prepared according to Conditions A, B, and F in Table 1. It is seen that the presence of pigment increases the average color gamut for both exemplary recording sheets prepared according to Conditions A and F in Table 1. These exemplary recording sheets also exhibit a higher average color gamut compared to the comparative recording sheet prepared according to Conditions B.

Example 8

Figure 9:
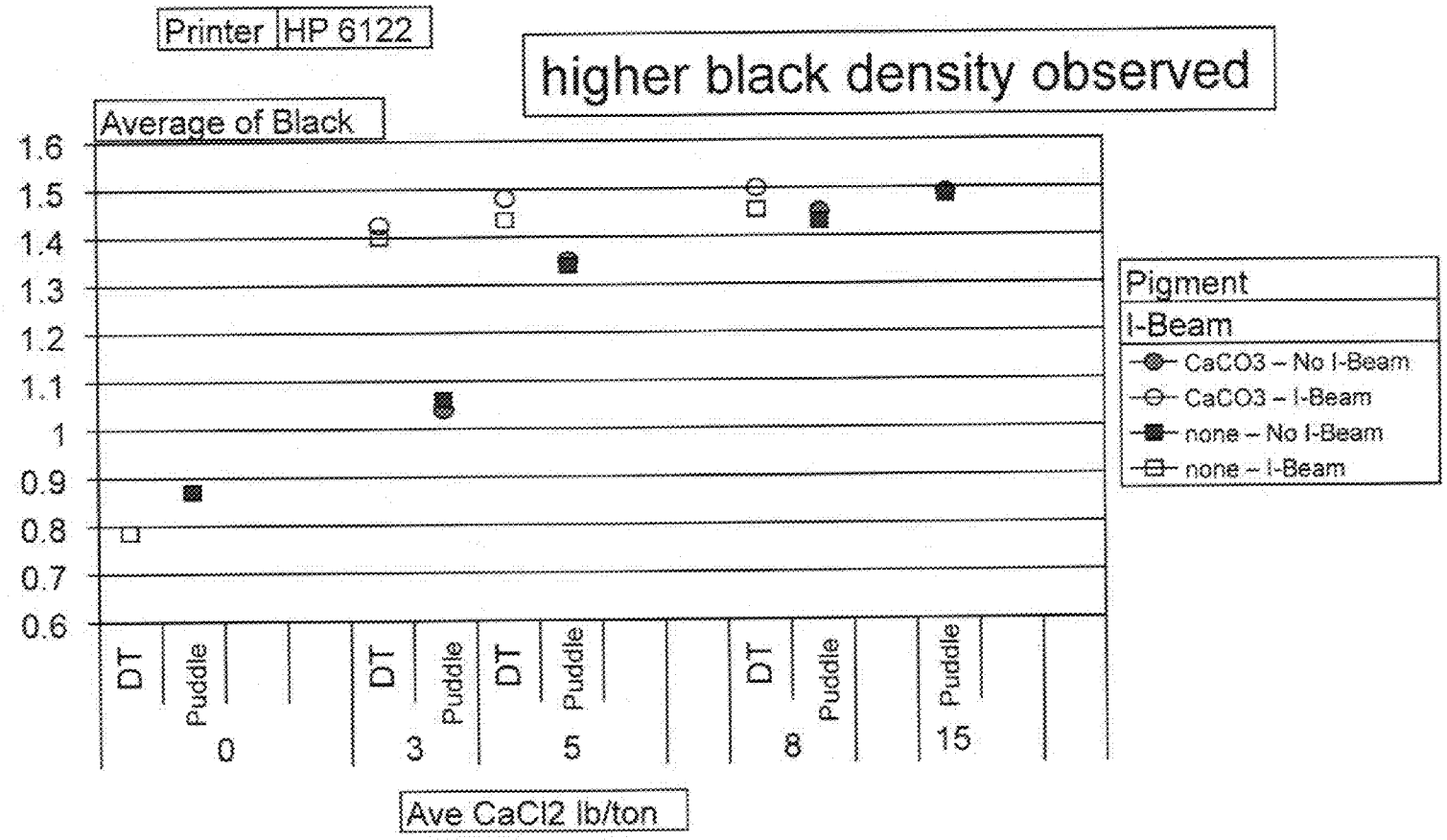
FIG. 9 is a graph showing the average of black density on they-axis for comparative and exemplary pigment-containing and non-pigment-containing embodiments in the examples.
Figure 10:
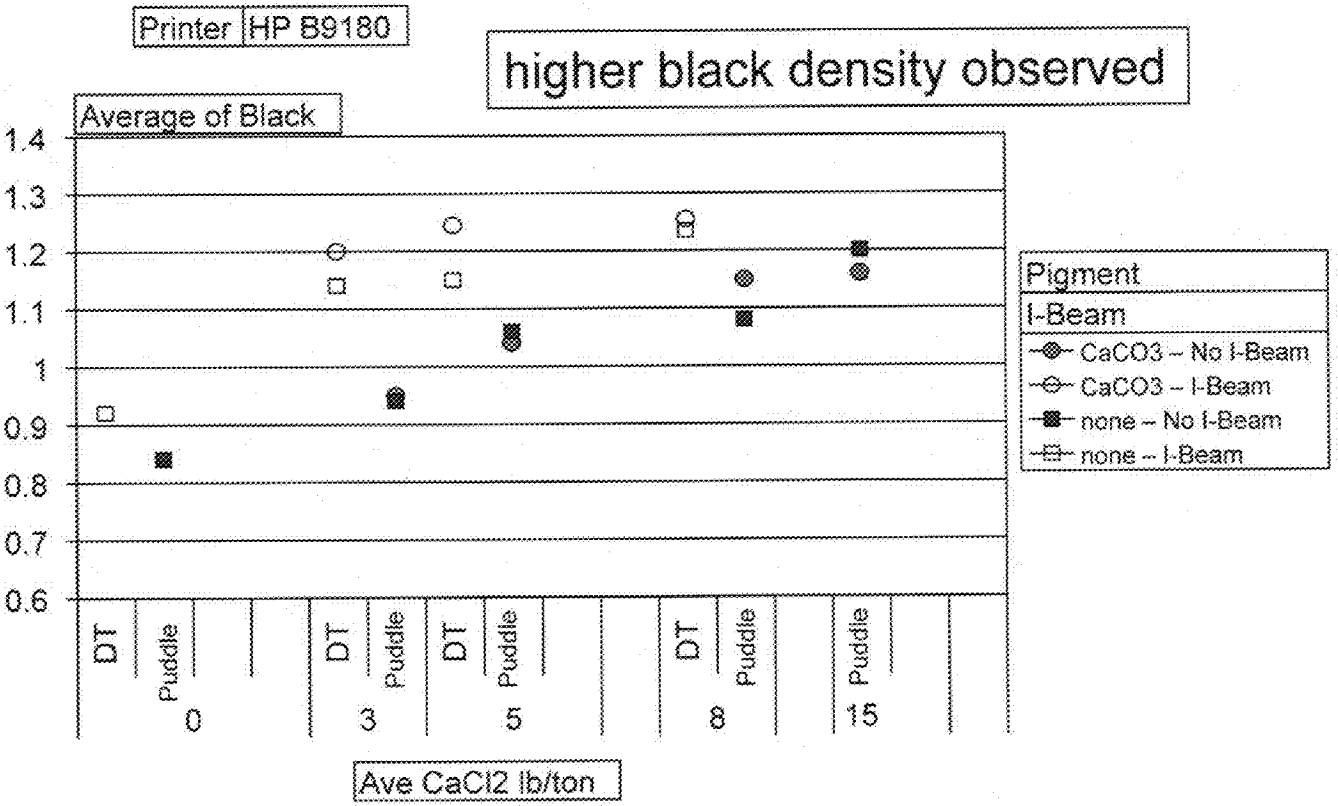
FIG. 10 is a graph showing the average of black density on the y-axis for comparative and exemplary pigment-containing and non-pigment-containing embodiments in the examples.
Figure 11:
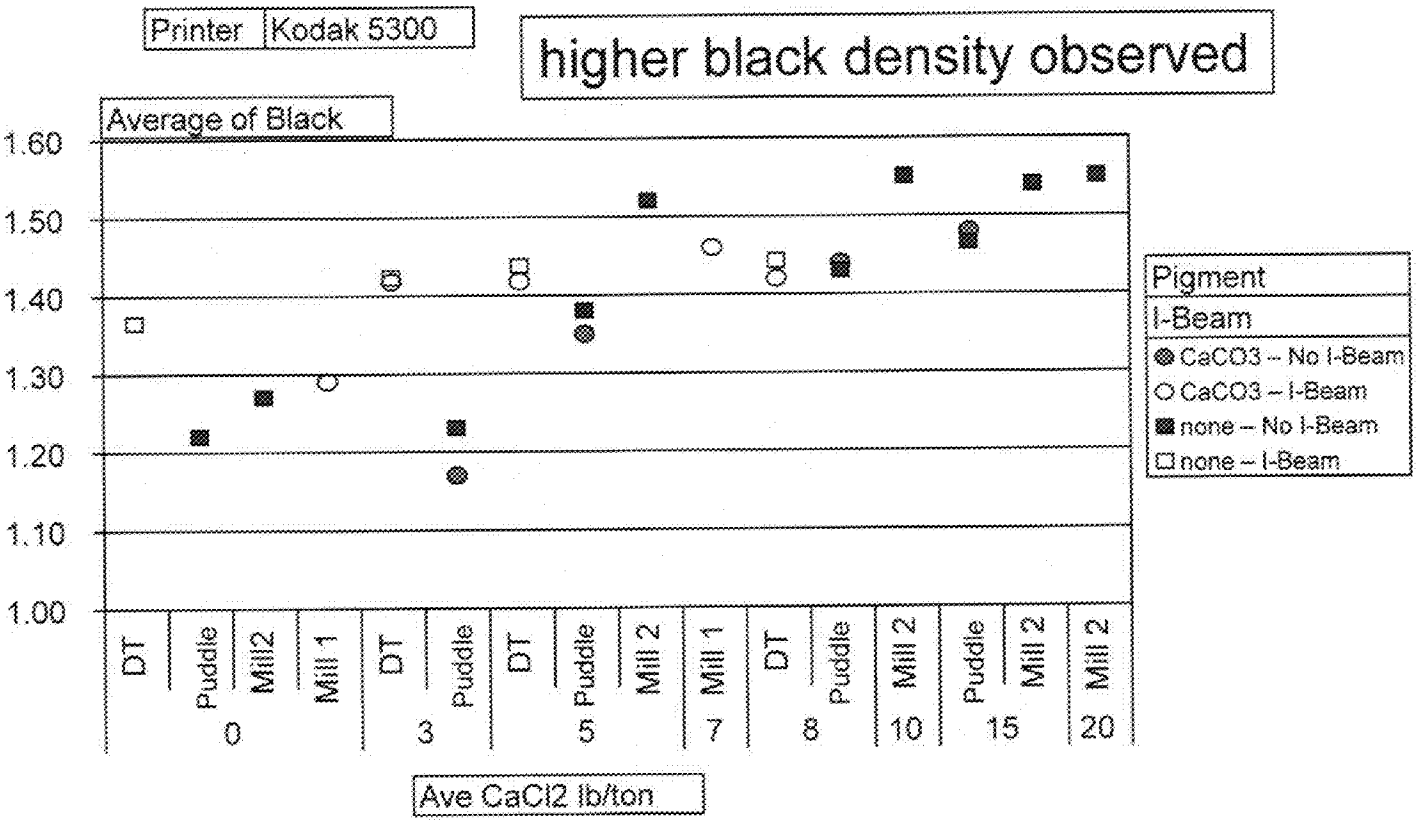
FIG. 11 is a graph showing the average of black density on the y-axis for comparative and exemplary pigment-containing and non-pigment-containing embodiments in the examples.
Figure 12:
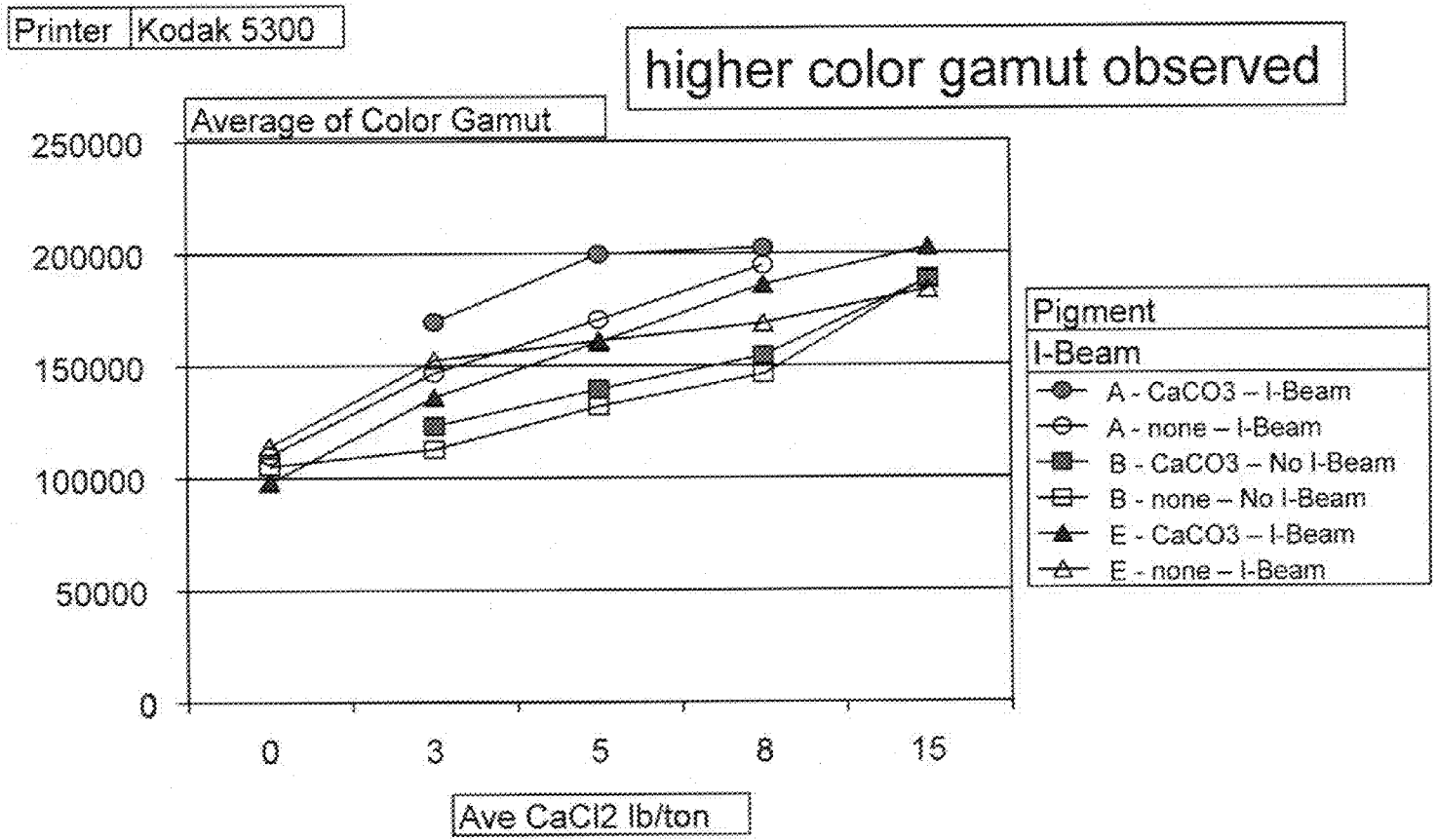
FIG. 12 is a graph showing the average of color gamut on the y-axis for comparative and exemplary pigment-containing and non-pigment-containing embodiments in the examples.
Figure 13:
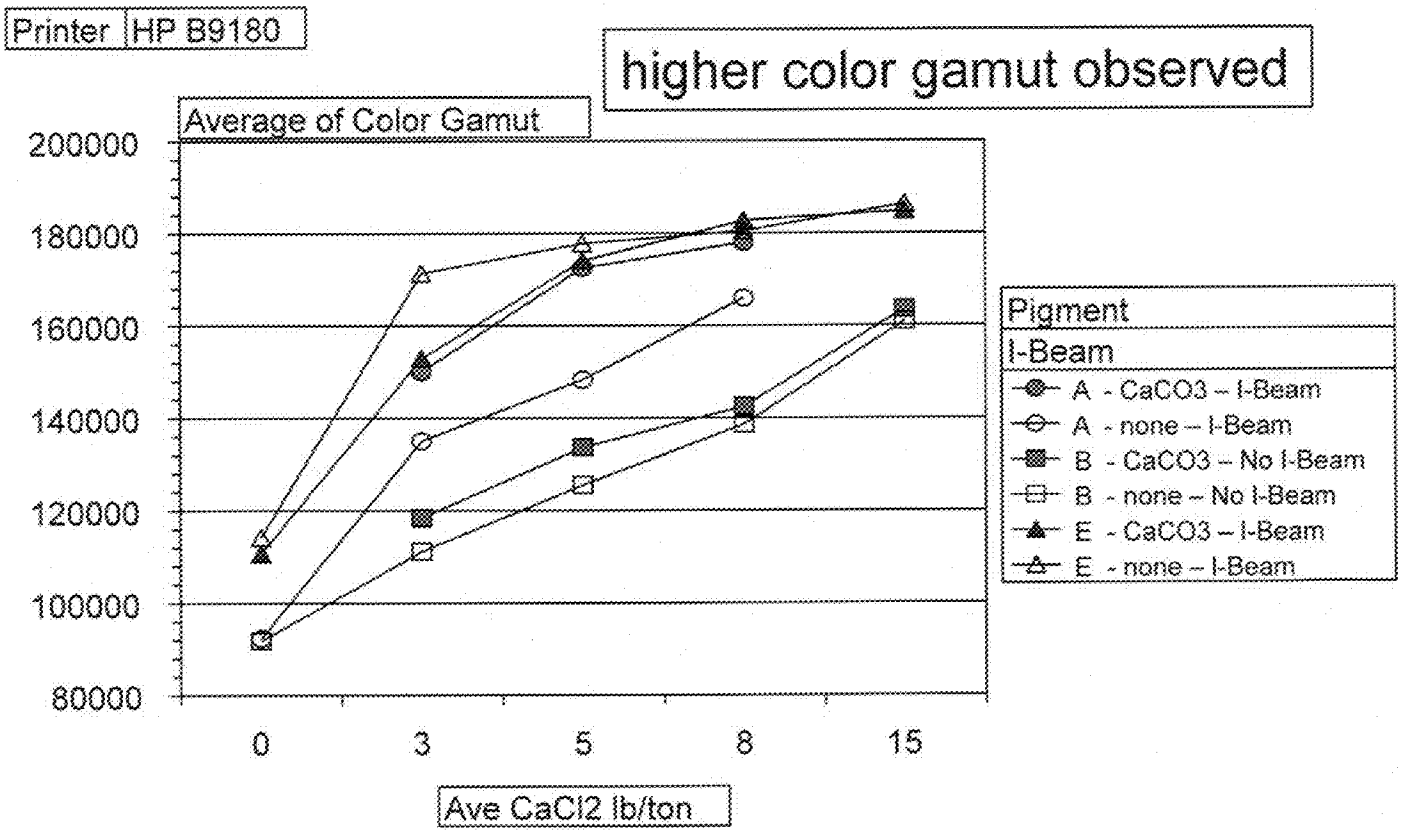
FIG. 13 is a graph showing the average of color gamut on the y-axis for comparative and exemplary pigment-containing and non-pigment-containing embodiments in the examples.
Figure 14:
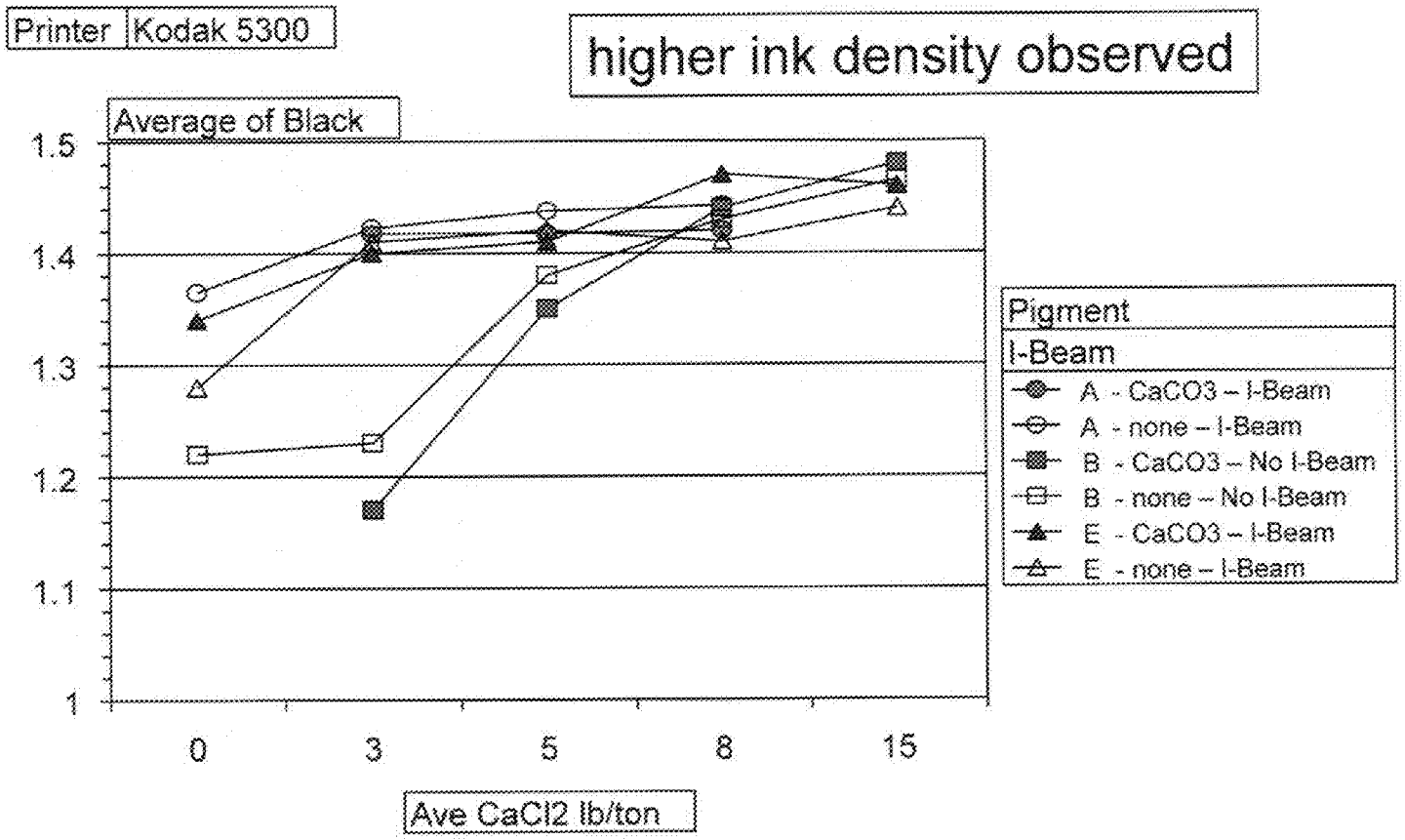
FIG. 14 is a graph showing the average of black density/ink jet print density on the y-axis for comparative and exemplary pigment-containing and non-pigment-containing embodiments in the examples.
Figure 15:
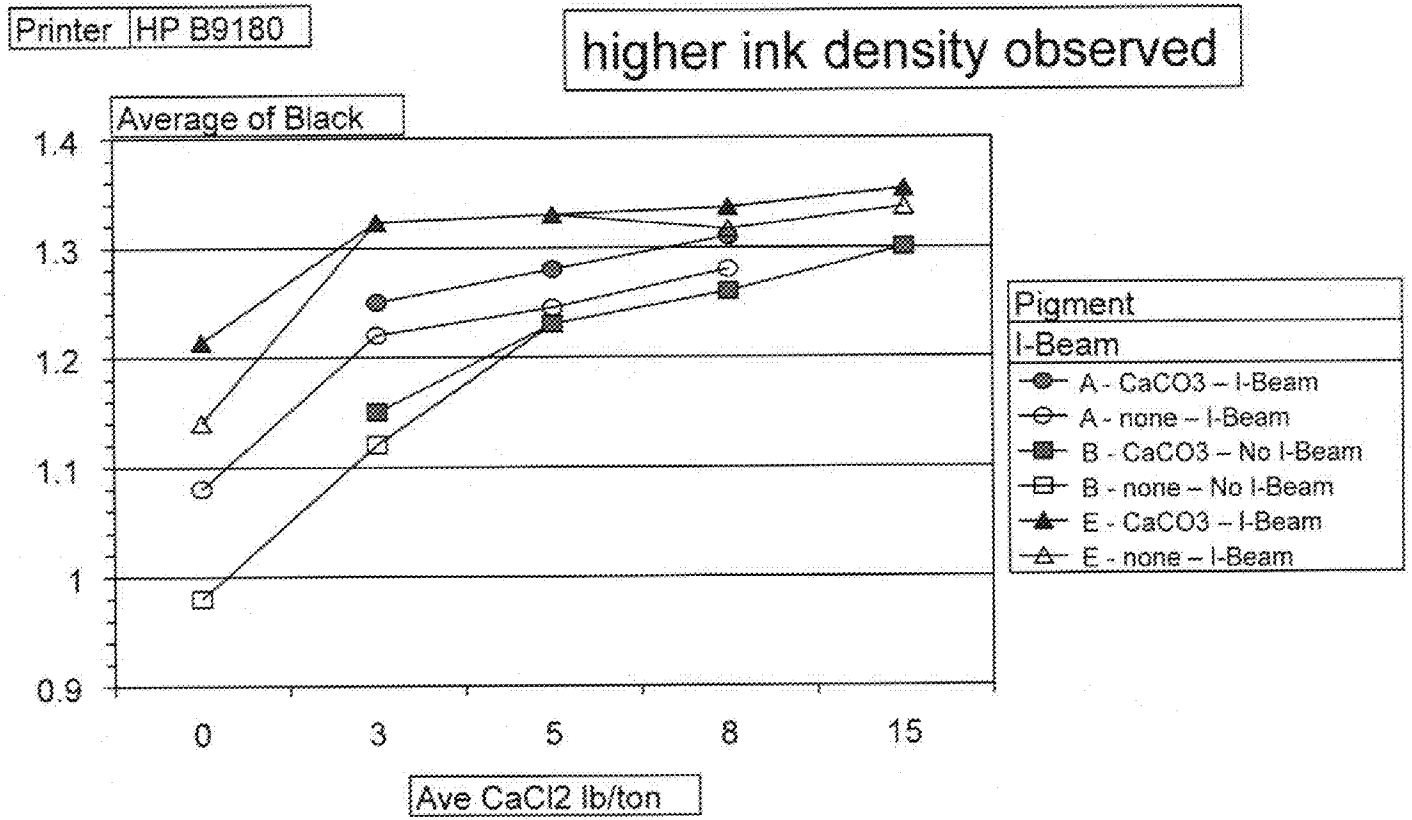
FIG. 15 is a graph showing the average of black density/ink density on the y-axis for comparative and exemplary pigment-containing and non-pigment-containing embodiments in the examples.

FIGS. 9, 10, and 11 show the results of the black density evaluation using three different printers, HP 6122, HP B9180, and Kodak 5300 on exemplary recording sheets prepared according to Conditions A and F and on comparative recording sheets prepared according to Conditions B, D and G.

While not wishing to be bound by theory, it is possible that the ink jet print density for pigmented inks may depend on salt concentration at the surface (vs. salt pickup (lbs/ton)). Surprisingly, the 1-Beam structure appears to give a boost to ink jet print density and color gamut. Pigment added at size press does allow better print density with less $CaCl_2$ added, which translates to a cost savings.

Example 9

Recording sheets were prepared in accordance with Conditions C and D. The data is not shown, but the print results were mixed for the recording sheet prepared with Condition C. Optical microscopy of iodine-stained samples (not shown) showed that both of Conditions C (i.e., with and without GCC pigment) gave non-I-Beam structures. One reason for may be due to the back coating saturating the sheet at the higher temperatures.

Example 10

Recording sheets were prepared in accordance with Conditions A, B and E in Table 1. Average of Color Gamut and ink density were evaluated over two different printers, HP B9180 and Kodak 5300. The results are shown in FIGS. 12-15. The print results obtained for the pigmented and non-pigmented recording sheets (Condition E) were similar to those sheets prepared in accordance with Condition A. Optical microscopy of iodine-stained samples (not shown) showed that both pigmented and non-pigmented Condition E recording sheets gave I-Beam structures.

Example 10

Sheet Splitting Method and Divalent Metal Salt Analysis

Sheet Splitting Method (a) Two glass plates with ground edges are needed, with dimensions of 2" wide by 8" long by ¼" thick. Take one of the glass plates and cut a piece of double-sided tape with liner. Remove the liner from one side of the tape and attach the tape to the glass plate. The tape should be firmly attached to the glass plate and smooth on the glass plate, with no air bubbles. Re move the liner from the other side of the tape, and trim the tape so that the tape does not extend beyond the edges of the glass plate.

(b) Weigh the tape and glass plate, and record the weight to an accuracy of 0.0001 g.

(c) Place a piece of paper to be tested on a flat table top. Press the glass plate with tape (tape side down) onto the piece of paper so that the paper adheres to the tape. Trim the paper so that it does not extend past the edges of the tape.

(d) Weigh the glass plate, tape, and paper, and record the weight to an accuracy of 0.0001 g.

(e) Subtract the weight from step (b) from the weight in step (d) to determine the total weight of the paper to be tested.

(f) Place a piece of double-sided tape smoothly on top of the paper after removing the liner from one side of the tape. The tape should be longer than the paper, so that it overhangs on both sides of the paper by 1 inch or so.

(g) Pull the tape from one end, beginning to split the paper thickness, but stop before reaching the end of the sheet.

(h) Lower the tape to bring the sheet back together, then remove the liner from the back of the tape. Place the second glass plate on top of the tape, sticking the glass to the tape. Press the assembly together to ensure good adhesion of the second glass plate to the tape.

(i) Pull the two glass plates apart, completing the sheet splitting. Trim the excess tape from the second glass plate.

(j) Weigh the first glass plate, tape, and paper, and record the weight to an accuracy of 0.0001 g.

(k) Subtract the weight in step (j) from the weight in step (b) to determine the weight of the paper remaining on the first glass plate.

(l) Subtract the weight in step (j) from the weight in step (d) to determine the weight of the paper transferred to the second glass plate.

(m) Place a piece of single-sided tape on the paper still remaining on the first glass plate. Peel the tape off, and reweigh the first glass plate, tape, and paper remaining.

(n) Subtract the weight in step (m) from the weight in step (k) to determine how much paper was removed by the single-sided tape.

(o) Continue removing portions of the paper remaining on the first glass plate until 25% of the initial weight of the paper to be tested (as measured in step (e)) remains on the first glass plate.

(p) Collect these single-sided tape and paper samples, label, and place them in a plastic bag for later analysis.

(q) Repeat steps (m) through (o) with the second glass plate.

(r) Remove the double-sided tape from the glass plates, and label.

Divalent Metal Salt Analysis

Procedure for full sheet samples (8.5"×11"):

(a) A 2.2 g portion of the paper to be tested was cut from the paper sample submitted for analysis.

(b) This paper portion was placed in 50 ml of reverse osmosis purified water (RO water), and soaked for two hours.

(c) The water solution was then filtered with standard filter paper, and washed with 30 ml of additional RO water.

(d) More RO water was then added to the filtered solution to bring the final volume to 100 ml.

(e) The solutions were then acidified with nitric acid, and diluted to 500 ml. They were then analyzed by ICP-MS for the determination of concentrations of ions of a divalent metal sale, for example if the salt is calcium chloride, the ions determined would be Ca, Cl. Also, because substrates may contain monovalent metal salts such as sodium chloride, the amounts of the NA ion would be determined so as to enable the calculation of the correct amount of calcium chloride.

(f) The amounts of divalent metal salt in the paper were calculated from the measured concentrations of ions corrected for the presence of monovalent metal salts and reported as parts per million (ppm) based on the weight of divalent metal salt and the as received paper weight.

Modified Procedure for Split sheet samples:

(a) The paper sample adhered to the tape was soaked in 30 ml of RO water for two hours.

(b) The water solution was then filtered with standard filter paper, and washed with 20 ml of additional RO water.

(c) More RO water was then added to the filtered solution to bring the final volume to 50 ml.

(d) The solutions were then acidified with nitric acid, and diluted to 100 ml. They were then analyzed by ICP-MS for the determination of concentrations of ions from divalent metal salts and monovalent metal salts (similar to above).

(e) The amounts of divalent metal salt in the paper were calculated from the measured concentrations of ions as discussed above and corrected for the presence of monvalent metal salt, and reported as parts per million (ppm) based on the weight of divalent metal salt and the as received paper weight (as given by the sheet splitting method).

(f) These concentrations of divalent metal salt were then compared with the results obtained by a full sheet analysis of a sheet from the same ream of paper or trial condition to determine how the divalent metal salt content of the full sheet was distributed in the split sheet samples.

Application of Sheet Splitting Method and Divalent Metal Salt Analysis

Two papers were tested using the sheet splitting method to determine the distribution of calcium chloride, a divalent metal salt, throughout the sheet. The first paper (Inventive Sample) was made on a pilot size press which was used in rod metering mode to apply a sizing composition containing starch and calcium chloride to one side of the paper. The second paper was a commercially available paper produced and sold by International Paper Company, the paper containing a composition containing calcium chloride and starch applied at the size press. The split sheet analysis and full sheet analysis are shown in Table 2.

TABLE 2

Summary of split sheet and full sheet calcium chloride analysis.

| Sample | Full sheet (ppm CaCl2) | Split sheet (outer 25%) (ppm CaCl2) |
|---|---|---|
| Commercial paper | 10,000 | 12,500 |
| Inventive Sample | 1,600 | 6,300 |

This data shows that the commercially available sheet has a fairly homogeneous distribution of calcium chloride throughout the sheet, with only a slightly higher concentration of calcium chloride on the surface compared with the average concentration of calcium chloride throughout the sheet. On the other hand, the Inventive Sample shows a much higher concentration of calcium chloride in the outermost 25% of the sheet as compared with the average concentration throughout the sheet. In fact, if the concentration of the outer 25% of the sheet is divided by four, the result is 1,575 ppm, which is remarkably similar to the average concentration throughout the sheet. This means that almost all the calcium chloride is found in the outer 25% of the sheet.

As used throughout, ranges are used as a short hand for describing each and every value that is within the range, including all subranges therein.

Numerous modifications and variations on the present invention are possible in light of the above teachings. It is, therefore, to be understood that within the scope of the accompanying claims, the invention may be practiced otherwise than as specifically described herein.

What is claimed is:

1. A recording sheet, comprising a web of cellulosic fibers; and a composition comprising a binder and a divalent metal salt, wherein said composition is applied to at least one surface of said web such that an effective concentration of divalent metal salt is located a distance that is within 25% from the at least one surface of said substrate and at least a majority of a total concentration of the divalent metal salt is located a distance that is within 25% from the at least one surface of said substrate.

2. The recording sheet according to claim 1, wherein the paper substrate and sizing agent cooperate to form an I-beam structure.

3. The recording sheet of claim 2, wherein said salt is present in an amount of 2.5-165 mol of cations/ton of paper substrate.

4. The recording sheet of claim 2, wherein the sizing agent further comprises at least one selected from the group consisting of starch, pigment, and a combination thereof.

5. The recording sheet of claim 2, wherein, when said sheet further comprises a printed image thereon, the image exhibits an average color gamut of about 120,000 or greater.

6. The recording sheet of claim 2, wherein, when said sheet further comprises a printed image thereon, the image exhibits a black density of about 1 or greater.

7. The recording sheet of claim 2, wherein the sizing agent is applied at a size press.

8. The recording sheet according to claim 2, having:
a percent ink transferred (IT %) of less than or equal to about 60.

9. The recording sheet according to claim 2, having:
a hygroexpansivity of from 0.6 to 1.25%.

10. The recording sheet according to claim 2, having:
a CD Internal Scott Bond of not more than 300 $J/m^2$.

11. The recording sheet according to claim 2, having:
an MD Internal Scott Bond of not more than 300 $J/m^2$.

12. The recording sheet according to claim 2, having:
a printed image thereon, the image exhibits an edge acuity ("EA") of less than about 15.

13. The recording sheet according to claim 1, having:
a percent ink transferred (IT %) of less than or equal to about 60; and
a CD Internal Scott Bond of not more than 300 $J/m^2$.

14. The recording sheet according to claim 1, having:
a percent ink transferred (IT %) of less than or equal to about 60; and
an MD Internal Scott Bond of not more than 300 $J/m^2$.

15. The recording sheet according to claim 1, having:
a hygroexpansivity of from 0.6 to 1.25%; and
a CD Internal Scott Bond of not more than 300 $J/m^2$.

16. The recording sheet according to claim 1, having:
a hygroexpansivity of from 0.6 to 1.25%; and
an MD Internal Scott Bond of not more than 300 $J/m^2$.

17. The recording sheet according to claim 1, having:
wherein, when said sheet further comprises a printed image thereon, the image exhibits an edge acuity ("EA") of less than about 15; and
a CD Internal Scott Bond of not more than 300 $J/m^2$.

18. The recording sheet according to claim 1, having:
a printed image thereon, the image exhibits an edge acuity ("EA") of less than about 15; and
an MD Internal Scott Bond of not more than 300 $J/m^2$.

19. The recording sheet according to claim 1, wherein said effective concentration of said divalent metal salt is selected such that the black density is at least 1.15.

20. The recording sheet according to claim 1, wherein said effective concentration of said divalent metal salt is at least 6000 ppm.

21. A method for making a recording sheet, comprising:
contacting a paper substrate comprising a plurality of cellulosic fibers; and
a size press formulation comprising a water soluble divalent metal salt;
to produce a recording sheet in which the paper substrate and a sizing agent comprising the water soluble divalent metal salt cooperate to form an I-beam structure.

22. The method of claim 21, wherein the contacting is carried out at a size press.

* * * * *